US009691397B2

(12) United States Patent
Kamano et al.

(10) Patent No.: US 9,691,397 B2
(45) Date of Patent: Jun. 27, 2017

(54) DEVICE AND METHOD DATA FOR EMBEDDING DATA UPON A PREDICTION CODING OF A MULTI-CHANNEL SIGNAL

(71) Applicant: FUJITSU LIMITED, Kawasaki-shi, Kanagawa (JP)

(72) Inventors: Akira Kamano, Kawasaki (JP); Yohei Kishi, Kawasaki (JP); Masanao Suzuki, Yokohama (JP); Shunsuke Takeuchi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 523 days.

(21) Appl. No.: 14/087,121

(22) Filed: Nov. 22, 2013

(65) Prior Publication Data

US 2014/0278446 A1 Sep. 18, 2014

(30) Foreign Application Priority Data

Mar. 18, 2013 (JP) ..... 2013-054939

(51) Int. Cl.
*G10L 19/008* (2013.01)
*G10L 19/04* (2013.01)
*G10L 19/018* (2013.01)

(52) U.S. Cl.
CPC ..... *G10L 19/008* (2013.01); *G10L 19/018* (2013.01); *G10L 19/04* (2013.01)

(58) Field of Classification Search
CPC ..... G10L 19/008
(Continued)

(56) References Cited

U.S. PATENT DOCUMENTS 5,956,674 A * 9/1999 Smyth ..... G10L 19/0208 704/200.1
5,974,380 A * 10/1999 Smyth ..... G10L 19/0208 704/201
(Continued)

FOREIGN PATENT DOCUMENTS

JP 4-51100 2/1992
JP 2000-13800 1/2000
(Continued)

OTHER PUBLICATIONS

Kineo Matsui, "Basic Knowledge of Digital Watermark", Morikita Publishing Co. Ltd., Section 7.7, pp. 184-194, Aug. 1998.
(Continued)

*Primary Examiner* — Michael N Opsasnick
(74) *Attorney, Agent, or Firm* — Staas & Halsey LLP

(57) ABSTRACT

A device for embedding data upon a prediction coding of a multi-channel signal includes a storage unit to store a code book that includes a plurality of prediction parameter sets, each of the plurality of prediction parameter sets including a plurality of kinds of prediction parameters for a processing regarding the prediction coding. The device extracts a plurality of candidates of a prediction parameter set for the multi-channel signal from the code book, wherein the plurality of candidates are capable of suppressing a prediction error in the prediction coding within a predetermined range, converts an embedding object that is at least part of the data in accordance with a number corresponding to a number of the candidates, selects, from the plurality of candidates, the prediction parameter set corresponding to the converted embedding object, and multiplexes the selected prediction parameter set with coded data which are down-mixed from the multi-channel signal.

13 Claims, 35 Drawing Sheets

(58) Field of Classification Search
USPC ..... 704/500–504
See application file for complete search history.

(56) References Cited

U.S. PATENT DOCUMENTS 5,978,762 A * 11/1999 Smyth ..... G10L 19/0208 704/200.1
8,655,670 B2 * 2/2014 Purnhagen ..... G10L 19/008 704/220
2004/0078205 A1 4/2004 Liljeryd et al.
2006/0047522 A1 * 3/2006 Ojanpera ..... G10L 19/18 704/503
2006/0140412 A1 6/2006 Villemoes et al.
2007/0081597 A1 * 4/2007 Disch ..... H04S 3/008 375/242
2009/0063164 A1 3/2009 Wu et al.
2011/0173007 A1 7/2011 Multrus et al.
2011/0173009 A1 7/2011 Fuchs et al.
2011/0224994 A1 * 9/2011 Norvell ..... G10L 19/008 704/500
2012/0078640 A1 * 3/2012 Shirakawa ..... G10L 19/0212 704/500
2012/0245947 A1 9/2012 Neuendorf et al.
2013/0030819 A1 * 1/2013 Purnhagen ..... G10L 19/008 704/500
2013/0121411 A1 * 5/2013 Robillard ..... G10L 19/008 375/240.12
2014/0278446 A1 9/2014 Kamano et al.

FOREIGN PATENT DOCUMENTS

JP 2002-344726 11/2002
JP 2008-517338 5/2008
JP 2009-213074 9/2009
WO 2007/140809 A1 12/2007

OTHER PUBLICATIONS

Lu, Zhe-Ming, et al., "Watermarking Combined with CELP Speech Coding for Authentication", IEICE Transactions on Information and Systems, The Institute of Electronics, Information and Communication Engineers, Tokyo, Japan, vol. E88-D, No. 2, Feb. 2005, pp. 330-334.
Extended European Search Report issued by the European Patent Office on Oct. 29, 2013 in corresponding international patent application No. 13170393.6-1910.
Office Action issued Mar. 30, 2017 in U.S. Appl. No. 13/912,674.
Advisory Action issued Feb. 2, 2017 in U.S. Appl. No. 13/912,674.
Office Action issued Feb. 29, 2016 in U.S. Appl. No. 13/912,674.
Office Action issued Sep. 2, 2016 in U.S. Appl. No. 13/912,674.

* cited by examiner

FIG. 25

372

370

| | FIRST FRAME | SECOND FRAME | THIRD FRAME |
|---|---|---|---|
| EMBEDDING VALUE | 1 | 3 | 3 |
| NUMBER OF CANDIDATES | 3 | 5 | 4 |

FIG. 28

440

| 442 NUMBER OF PREDICTION PARAMETER CANDIDATES | 444 EMBEDDING AMOUNT [bps] |
|---|---|
| 51 | 360 |

FIG. 34

ORIGINAL DATA 561

1 1 0 1 0 1 0 ···

ERROR CORRECTION CODING DATA 563

1 1 1 1 1 1 0 0 0 1 1 1 0 0 0 1 1 1 0 0 0 ···

EXTRACTED DATA 565

1 0 1 1 1 0 0 1 0 1 1 1 0 0 0 1 0 1 0 0 0 ···

ORIGINAL DATA 567

1 1 0 1 0 1 0 ···

DEVICE AND METHOD DATA FOR EMBEDDING DATA UPON A PREDICTION CODING OF A MULTI-CHANNEL SIGNAL

CROSS-REFERENCE TO RELATED APPLICATION

This application is based upon and claims the benefit of priority of the prior Japanese Patent Application No. 2013-054939, filed on Mar. 18, 2013, the entire contents of which are incorporated herein by reference.

FIELD

The embodiment discussed herein is related to a technique for embedding other information into data and a technique for extracting the other information which is embedded.

BACKGROUND

In an audio signal, for example, a sound is sampled and quantized on the basis of a sampling theorem so as to digitalize the sound through linear pulse coding. In particular, music software is digitalized in a manner that enormously high sound quality is maintained. On the other hand, such digitalized data is easily duplicable in a complete format. Therefore, there has been an attempt to embed copyright information and the like into music software in a format which is imperceptible by a human. As a method for appropriately embedding information into music software of which high-quality sound is demanded, a method for embedding information into a frequency component has been widely employed.

Further, an example of the related art is an information embedding device that varies compression code sequence, without changing the data quantity of the compression code sequence where image data are subjected to compression coding, in such a way that the data are not visually available. Such information embedding device decodes a compression code sequence for each block so as to generate a coefficient block. The information embedding device selects embedded data, which corresponds to the generated coefficient block and a bit value of input data, from an embedded data table and generates a new block, of which the total code length is unchanged, so as to embed other information. Such technique has been disclosed in Japanese Laid-open Patent Publication No. 2002-344726 and Kineo Matsui "Basic Knowledge of Digital Watermark", Morikita publishing Co. Ltd, pp. 184-194, for example.

SUMMARY

In accordance with an aspect of the embodiments, a data embedding device includes a storage unit configured to store a code book that includes a plurality of prediction parameters; a processor; and a memory which stores a plurality of instructions, which when executed by the processor, cause the processor to execute, extracting a plurality of candidates, of which a prediction error in prediction coding, the prediction coding being based on signals of other two channels, of a signal of one channel among signals of a plurality of channels is within a predetermined range, of a prediction parameter from the code book and extracting the number of candidates of the prediction parameter, the candidates being extracted; converting at least part of data that is an embedding object into a number base based on the number of candidates; and selecting a prediction parameter, the prediction parameter being a result of the prediction coding, from the candidates, the candidates being extracted, in accordance with a predetermined embedding rule, the predetermined embedding rule corresponding to the number base that is converted by converting, so as to embed the data, the data being an embedding object, into the prediction parameter as the number base.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 25 illustrates an example of buffer information;

FIG. 28 illustrates a simulation result of a data embedding amount;

FIG. 34 illustrates an example of error correction coding processing with respect to embedded information according to modification 4.

DESCRIPTION OF EMBODIMENT

Figure 1:
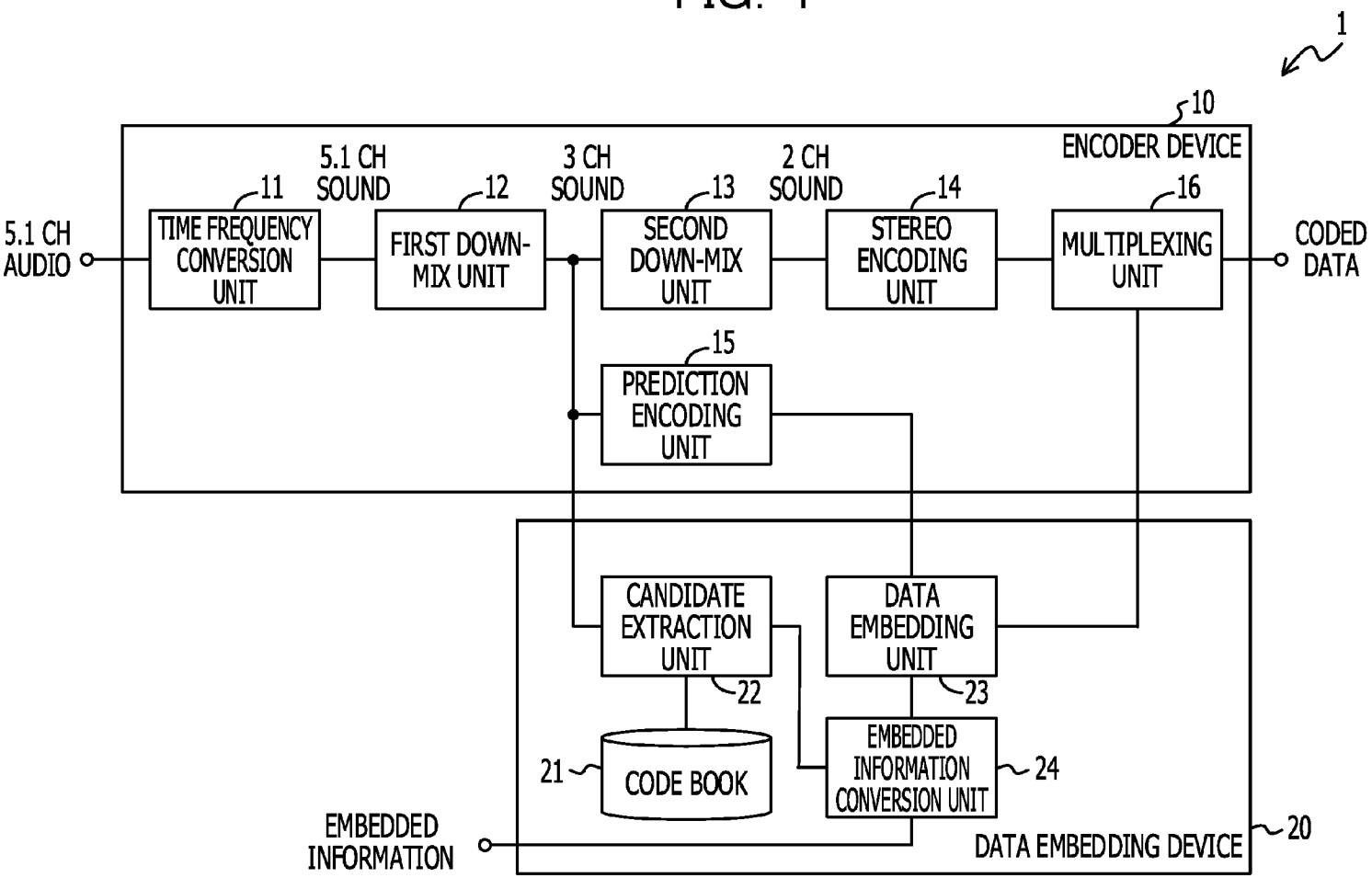
FIG. 1 illustrates an example of the configuration of an encode system.
Figure 2:
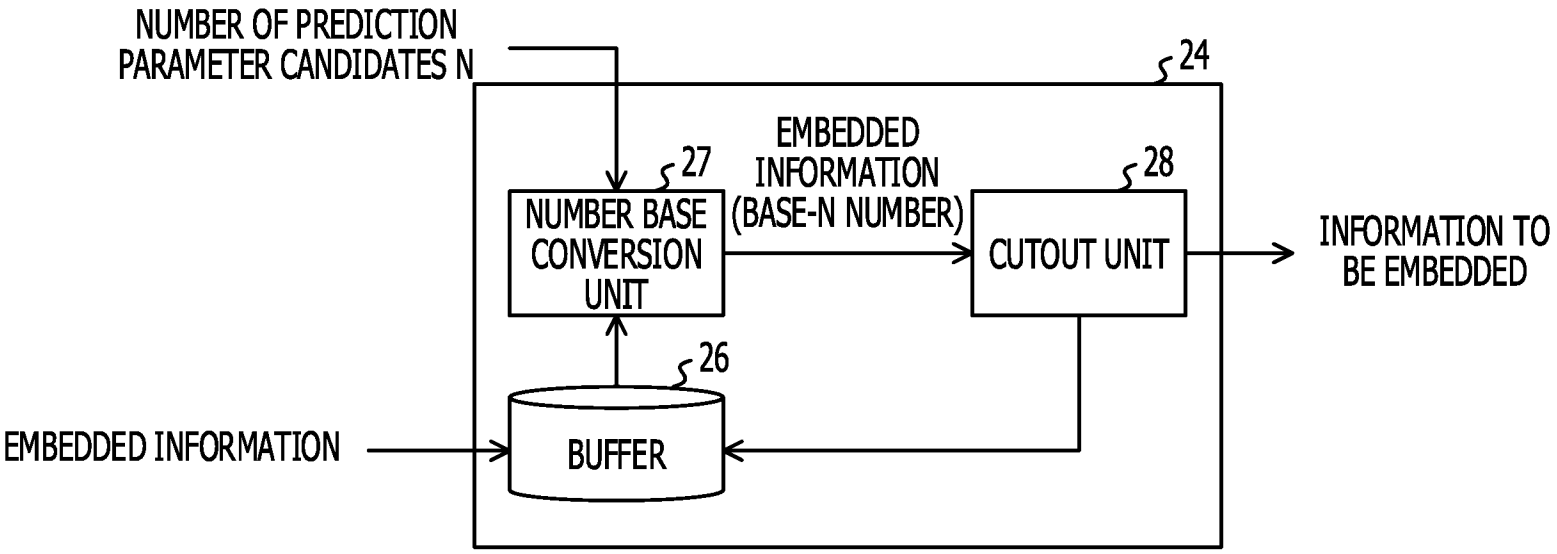
FIG. 2 illustrates an example of the configuration of an embedded information conversion unit.
Figure 3:
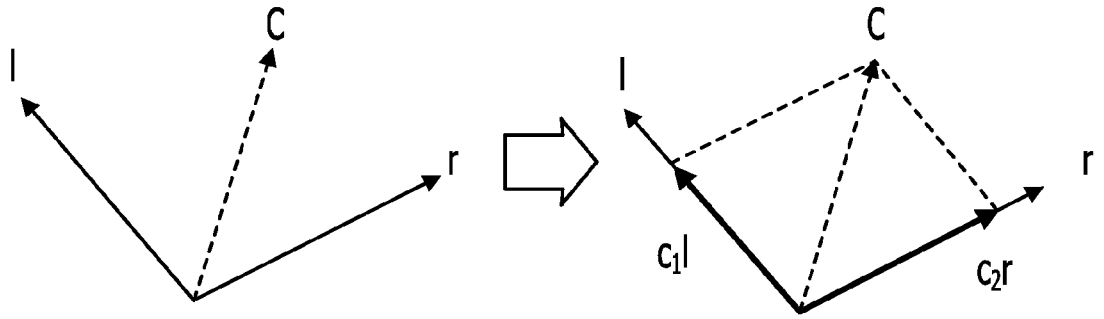
FIG. 3 is an explanatory diagram illustrating up-mix from 2 channels to 3 channels.

A data embedding device and a data extraction device according to an embodiment are described below with reference to the accompanying drawings. FIG. 1 illustrates an example of the configuration of an encode system 1 according to the embodiment. FIG. 2 illustrates an example of the configuration of an embedded information conversion unit. FIG. 3 is an explanatory diagram illustrating up-mix from 2 channel to 3 channel of a decode system.

As depicted in FIG. 1, the encode system 1 is a system which compresses a multi-channel audio signal, encodes the audio signal, and embeds information such as copyright information, for example.

The encode system 1 includes an encoder device 10 and a data embedding device 20. The encoder device 10 includes a time frequency conversion unit 11, a first down-mix unit 12, a second down-mix unit 13, a stereo encoding unit 14, a prediction encoding unit 15, and a multiplexing unit 16. The data embedding device 20 includes a code book 21, a candidate extraction unit 22, a data embedding unit 23, and an embedded information conversion unit 24. As depicted in FIG. 2, the embedded information conversion unit 24 includes a buffer 26, a number base conversion unit 27, and a cutout unit 28.

These constituent elements included in the encode system 1 and depicted in FIGS. 1 and 2 are respectively formed as independent circuits. Alternatively, the elements of the encode system may be implemented as an integrated circuit in which part or all of these constituent elements are integrated. Further, these constituent elements may be function modules which are realized by a program which is executed on an arithmetic processing device which is included in each of the elements of the encode system 1.

Hereinafter, moving picture experts group (MPEG) surround is used as a coding system for compressing data quantity of a multi-channel audio signal. The MPEG surround is a coding system which is standardized in the moving picture experts group (MPEG). Here, the MPEG surround is explained.

In the MPEG surround, frequencies of audio signal (time signals), which are coding objects, of 5.1 channels, for example, are converted and obtained frequency signals are down-mixed, thus first generating frequency signals of 3 channels. Subsequently, the frequency signals of the 3 channels are down-mixed again and thus frequency signals, which correspond to a stereo signal, of 2 channels are calculated. Then, the frequency signals of the 2 channels are encoded on the basis of the advanced audio coding (AAC) system and the spectral band replication (SBR) coding system. Here, in the down-mix from the signals of the 5.1 channels to the signals of the 3 channels and in the down-mix from the signals of the 3 channels to the signals of the 2 channels, spatial information which represents spread and localization of sounds is calculated and this spatial information is also encoded at the same time, in the MPEG surround.

Thus, in the MPEG surround, a stereo signal which is generated by down-mixing a multi-channel audio signal and spatial information of which the data quantity is relatively small are encoded. Accordingly, higher compression efficiency is obtained in the MPEG surround compared to a case in which signals of respective channels which are included in a multi-channel audio signal are independently encoded.

In this MPEG surround, a prediction parameter is used so as to encode spatial information which is calculated when a stereo frequency signal which is signals of 2 channels is generated. A prediction parameter is a coefficient which is used for performing prediction for obtaining signals of 3 channels by up-mixing down-mixed signals of 2 channels, that is, prediction of a signal of one channel among 3 channels, on the basis of signals of other 2 channels. This up-mixing is explained with reference to FIG. 3.

In FIG. 3, down-mixed signals of 2 channels are represented by an l vector and an r vector respectively and one signal which is obtained from these signals of 2 channels through up-mixing is represented by a c vector. In the MPEG surround, it is assumed that the c vector is predicted on the basis of formula (1) below by using prediction parameters $c_1$ and $c_2$ in this case.

$$c=c_1 l+c_2 r \tag{1}$$

Here, a plurality of values of prediction parameters are prestored in a table which is referred to as a "code book" such as the code book 21, for example. The code book is used for improving used bit efficiency. In the MPEG surround, pairs of $c_1$ and $c_2$ of 51 pieces×51 pieces, each of which is obtained by segmenting a region which is from −2.0 to +3.0 inclusive by a width of 0.1, are prepared as a code book. Accordingly, 51×51 grid points are obtained when the pairs of prediction parameters are plotted on an orthogonal two-dimensional coordinate system formed by two coordinate axes $c_1$ and $c_2$.

Referring back to FIG. 1, into the encoder device 10, audio signals of a time region of 5.1 channels which are composed of signals of 5 channels in total which are a left forward channel, a central channel, a right forward channel, a left backward channel, and a right backward channel and a low-frequency exclusive signal of a 0.1 channel is inputted. The encoder device 10 encodes the audio signals of the 5.1 channels and outputs coded data. On the other hand, the data embedding device 20 is a device which embeds other data into coded data which is outputted by the encoder device 10, and embedded information which is to be embedded into coded data is inputted into the data embedding device 20. Here, the embedded information is information which is to be embedded into audio data, such as copyright information. An output of the encode system 1 is coded data which is outputted from the encoder device 10 and in which embedded information is embedded.

The time frequency conversion unit 11 of the encoder device 10 converts audio signals, which are inputted into the encoder device 10, of the time region of the 5.1 channels into frequency signals of the 5.1 channels. In the embodiment, the time frequency conversion unit 11 performs time frequency conversion in a frame unit which is performed by using a quadrature mirror filter (QMF), for example. Through the conversion, frequency component signals of respective regions which are obtained by equally dividing an audio frequency region of one channel (64 equal regions, for example) are obtained from the inputted audio signals of the time region. Processing which is performed in each function block of the encoder device 10 and the data embedding device 20 of the encode system 1 is performed for each of frequency component signals of respective regions.

Every time the first down-mix unit 12 receives frequency signals of the 5.1 channels, the first down-mix unit 12 down-mixes the frequency signals of respective channels so as to generate frequency signals of 3 channels in total which are a left channel, a central channel, and a right channel.

Every time the second down-mix unit 13 receives frequency signals of the 3 channels from the first down-mix unit 12, the second down-mix unit 13 down-mixes the frequency signals of respective channels so as to generate frequency signals of 2 channels in total which are a left channel and a right channel.

The stereo encoding unit 14 encodes stereo frequency signals which are received from the second down-mix unit 13, in accordance with the above-mentioned AAC system and SBR coding system, for example.

The prediction encoding unit 15 performs processing for calculating a value of the above-mentioned prediction parameter which is used for prediction which is performed in up-mixing for restoring signals of the 3 channels from stereo frequency signals which are outputs of the second down-mix unit 13. Here, the up-mixing for restoring the signals of the 3 channels from the stereo frequency signals is performed in accordance with the above-mentioned method of FIG. 3 in a first up-mix unit 33 of a decoder device 30 which will be described later.

The multiplexing unit 16 arranges and multiplexes the above-mentioned prediction parameters and coded data which are outputted from the stereo encoding unit 14 so as to output the multiplexed coded data. Here, when the encoder device 10 is allowed to independently operate, the multiplexing unit 16 multiplexes prediction parameters which are outputted from the prediction encoding unit 15 with coded data. On the other hand, when the configuration of the encode system 1 depicted in FIG. 1 is employed, the multiplexing unit 16 multiplexes prediction parameters which are outputted form the data embedding device 20 with coded data.

In the code book 21 of the data embedding device 20, a plurality of prediction parameters are prestored. As this code book 21, a code book which is identical to a code book which is used when the prediction encoding unit 15 of the encoder device 10 obtains a prediction parameter is used. Here, the data embedding device 20 includes the code book 21 in the configuration of FIG. 1, but alternatively, a code book which is included in the prediction encoding unit 15 of the encoder device 10 may be used.

The candidate extraction unit 22 extracts a plurality of candidates of a prediction parameter of which a prediction error in prediction coding, which is based on two channels other than one channel, of a signal of the one channel among signals of a plurality of channels, from the code book 21. More specifically, the candidate extraction unit 22 extracts a plurality of candidates of a prediction parameter of which an error with respect to a prediction parameter, which is obtained by the prediction encoding unit 15, is within a predetermined threshold value, from the code book 21.

The data embedding unit 23 selects a prediction parameter which is a result of the prediction coding, from candidates which are extracted by the candidate extraction unit 22, in accordance with a predetermined data embedding rule, so as to embed embedded information into the corresponding prediction parameter. More specifically, the data embedding unit 23 selects a predication parameter which is to be an input to the multiplexing unit 16, from candidates which are extracted by the candidate extraction unit 22, in accordance with a predetermined data embedding rule, so as to embed embedded information into the corresponding prediction parameter. The predetermined embedding rule is a rule based on embedded information which is converted by the embedded information conversion unit 24 which will be described later.

As depicted in FIG. 2, the buffer 26 of the embedded information conversion unit 24 stores embedded information which is to be embedded into coded data. The number base conversion unit 27 acquires, from the candidate extraction unit 22, the number N of candidates of a prediction parameter which is extracted for each frame and converts embedded information which is acquired from the buffer 26 into a base-n number. The cutout unit 28 cuts out a part which is a number which does not exceed N, from the embedded information of the base-n number which is acquired from the number base conversion unit 27, so as to output the part as information which is to be embedded into a predication parameter of a frame which is a processing object, and outputs the rest of the embedded information to the buffer 26 so as to allow the buffer 26 to buffer the rest of the embedded information.

Candidate extraction processing which is performed by the candidate extraction unit 22 is now described with reference to FIGS. 4 to 11. The candidate extraction processing extracts, from the code book 21, a plurality of candidates of a prediction parameter of which an error with respect to a prediction parameter, which is obtained by the prediction encoding unit 15 of the encoder device 10, is within a predetermined threshold value.

An error between a prediction result, which is obtained by using a prediction parameter, of a signal of a single channel among a plurality of channels and an actual signal of the single channel is first described. This error is expressed as an error curved surface by changing a prediction parameter and graphing distribution. In the embodiment, an error curved surface is a curved surface, which is obtained by graphing distribution obtained by changing a prediction parameter, of a prediction error which is obtained when a signal of a central channel is predicted by using the predication parameter as depicted in FIG. 3.

Figure 4:
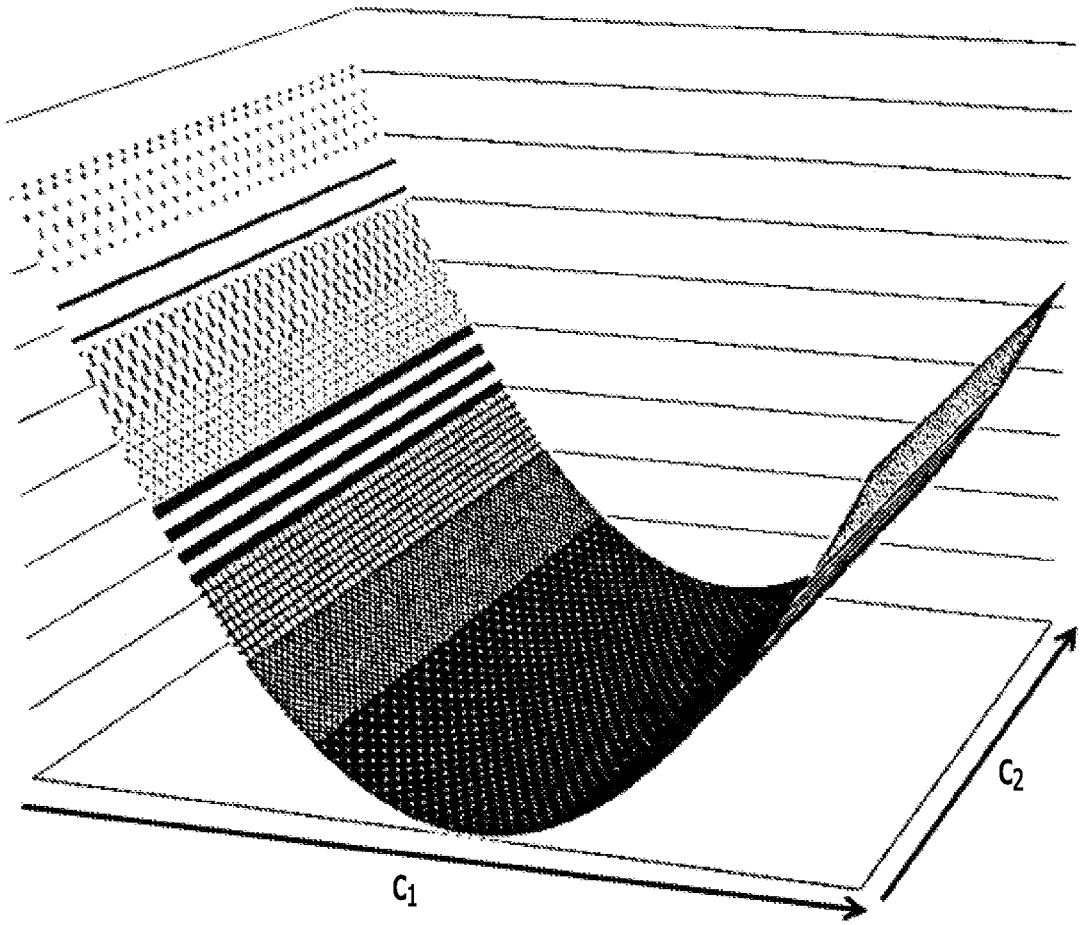
FIG. 4 illustrates an example of a parabolic error curved surface.
Figure 5:
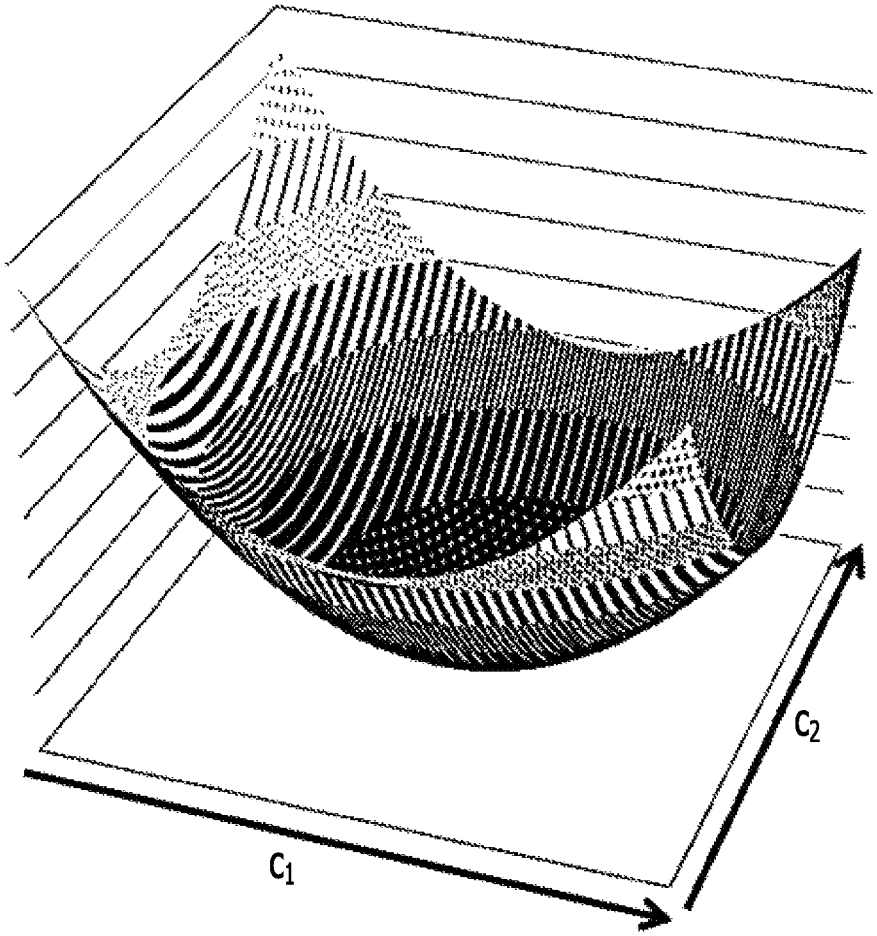
FIG. 5 illustrates an example of an elliptical error curved surface.

FIGS. 4 and 5 illustrate an error curved surface. FIG. 4 illustrates an example of a parabolic error curved surface, and FIG. 5 illustrates an example of an elliptical error curved surface. In both of FIGS. 4 and 5, an error curved surface is drawn on an orthogonal three-dimensional coordinate system. Here, directions of arrows $c_1$ and $c_2$ respectively represent magnitudes of values of prediction parameters of a left channel and a right channel, and a direction orthogonal to a plane which is spread by the arrows $c_1$ and $c_2$ (upper direction of the plane) represents a magnitude of a prediction error. Accordingly, a prediction error has an identical value even when any pair of values of predication parameters is selected to perform prediction of a signal of a central channel, on a plane parallel with the plane which is spread by the arrows $c_1$ and $c_2$.

Here, when an actual signal of a central channel is denoted as a signal vector $c_0$ and a prediction result of a signal of the central channel which is obtained by using signals of the left channel and the right channel and prediction parameters is denoted as a signal vector c, a prediction error d is expressed as formula (2) below.

$$d=\Sigma|c_0-c|^2=\Sigma|c_0-(c_1l+c_2r)|^2 \tag{2}$$

Here, l and r denote signal vectors respectively representing signals of the left channel and the right channel and $c_1$ and $c_2$ denote prediction parameters of the left channel and the right channel respectively.

When this formula (2) is transformed about $c_1$ and $c_2$, formula (3) below is obtained.

$$c_1 = \frac{f(l, r)f(r, c) - f(l, c)f(r, r)}{f(l, r)f(l, r) - f(l, l)f(r, r)} \tag{3}$$

$$c_2 = \frac{f(l, c)f(l, r) - f(l, l)f(r, c)}{f(l, r)f(l, r) - f(l, l)f(r, r)}$$

Here, a function f denotes an inner production of vectors.

The denominator of the right side member of formula (3), namely, formula (4) below is focused.

$$f(l,r)f(l,r)-f(l,l)f(r,r) \tag{4}$$

When a value of this formula (4) is zero, a shape of the error curved surface is parabolic as depicted in FIG. 4. When the value of formula (4) is not zero, the shape of the error curved surface is elliptical as depicted in FIG. 5. Accordingly, an inner product of the signal vectors of the signals, which are outputted from the first down-mix unit 12, of the left channel and the right channel is obtained and a value of formula (4) is calculated so as to determine the shape of the error curved surface depending on whether or not the value is zero. Here, when the shape of the error curved surface is elliptical, embedding of data is not performed.

A case where a value of formula (4) is zero is limited to any one of the following cases, namely, (1) a case where the r vector is a zero vector, (2) a case where the l vector is a zero vector, and (3) a case where the l vector is a constant multiple of the r vector. Accordingly, the shape of the error curved surface may be determined by examining whether or not the signals, which are outputted from the first down-mix unit 12, of the left channel and the right channel correspond to any of these three cases.

An error straight line is now described. An error straight line is aggregation of points of a minimum predication error on an error curved surface. When the error curved surface is parabolic, the aggregation of points forms a straight line. Here, when the error curved surface is elliptical, the number of points of the minimum predication error is one and therefore, a straight line is not formed.

In the example of the parabolic error curved surface of FIG. 4, a tangent line formed when a plane which is defined by the prediction parameters $c_1$ and $c_2$ contacts with the error curved surface is an error straight line. A prediction error is identical even when any pair, which is specified by a point on this error straight line, of values of the prediction parameters $c_1$ and $c_2$ is selected to perform prediction of a signal of the central channel.

Here, a formula of this error straight line is expressed by the following three formulas depending on a signal level of the left channel and the right channel. An error straight line is decided by assigning the signals, which are outputted from the first down-mix unit 12, of the left channel and the right channel to respective signal vectors of the right side member of these formulas.

First, when the r vector is a zero vector, that is, when the signal of the right channel is a silent signal, a formula of the error straight line is expressed as formula (5) below.

$$c_1 = \frac{f(r, c)}{f(r, r)} \tag{5}$$

Figure 6:
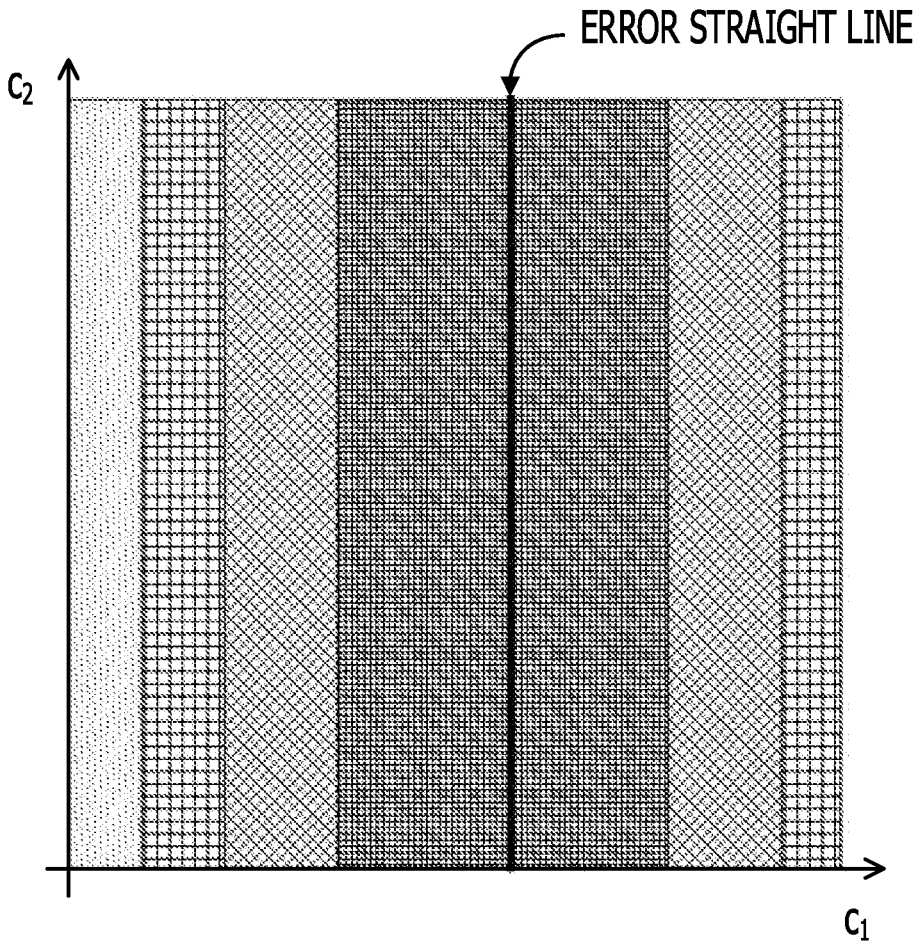
FIG. 6 illustrates an example of a projection drawing of an error curved surface.

FIG. 6 is an example of a projection drawing of an error curved surface. This projection drawing is obtained by drawing a straight line which is expressed by above formula (5) on the projection drawing of the error curved surface of FIG. 4 with respect to the plane which is spread by the arrows $c_1$ and $c_2$.

Second, when the l vector is a zero vector, that is, when the signal of the left channel is a silent signal, the formula of the error straight line is expressed as formula (6) below.

$$c_2 = \frac{f(l, c)}{f(l, l)} \tag{6}$$

Third, when the l vector is a constant multiple of the r vector, that is, when proportions of the l vector and the r vector are invariable in all samples in frames which are processing objects, the formula of the error straight line is expressed as formula (7) below.

$$c_2 = -\frac{l}{r}c_1 + \frac{l}{r}\frac{f(l, c)}{f(l, l)} \tag{7}$$

When both of the r vector and the l vector are zero vectors, that is, both of the signals of the right channel and the left channel are zero, aggregation of points of the minimum predication error does not form a straight line.

Prediction parameter candidate extraction processing performed by the candidate extraction unit 22 is now described with reference to FIGS. 7 to 11. This processing extracts candidates of a prediction parameter from the code book 21 on the basis of an error straight line which is obtained as described above.

In the prediction parameter candidate extraction processing, candidates of a prediction parameter are extracted on the basis of a positional relation between an error straight line and each point which corresponds to each prediction parameter which is stored in the code book 21, on a plane which is defined by the prediction parameters $c_1$ and $c_2$. In the prediction parameter candidate extraction processing of the embodiment, points of which a distance from the error straight line is within a predetermined range are selected among points which correspond to candidates of each prediction parameter which is stored in the code book 21, as the positional relation. Then, pairs of predication parameters which are represented by the selected points are extracted as candidates of the prediction parameter. A specific example of this processing is described with reference to FIG. 7.

Figure 7:
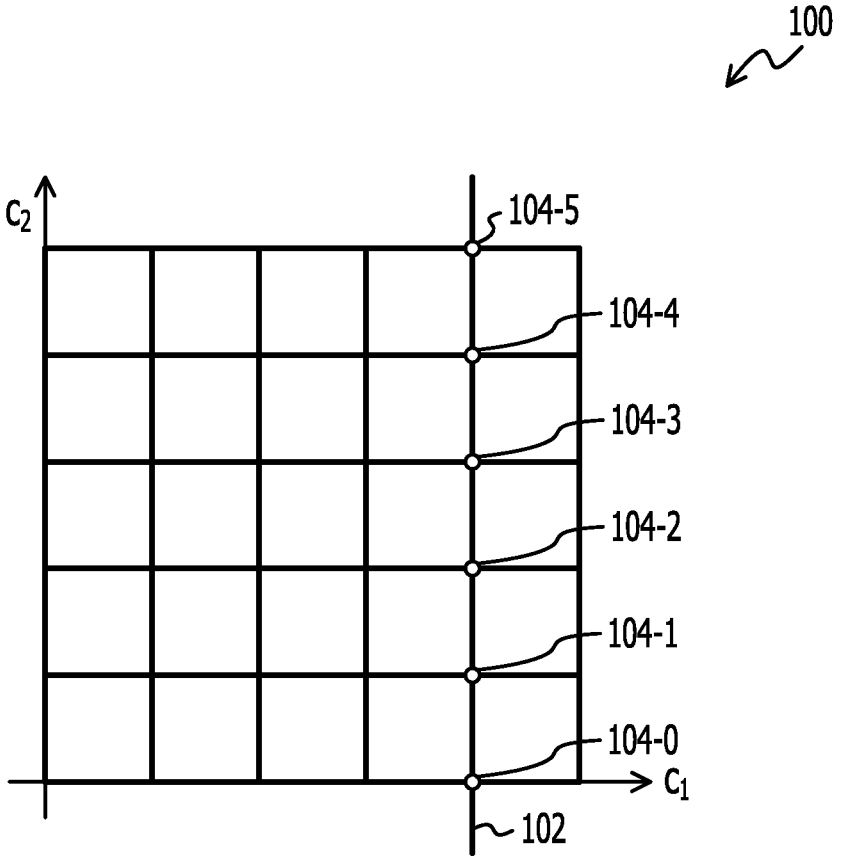
FIG. 7 illustrates an example of a pattern A of prediction parameter candidate extraction.

FIG. 7 illustrates a prediction parameter candidate extraction example. A prediction parameter candidate extraction example 100 of FIG. 7 corresponds to a pattern A which will be described later. As depicted in FIG. 7, in the prediction parameter candidate extraction example 100, points which correspond to respective prediction parameters which are stored in the code book 21 are arranged as grid points, on a two-dimensional orthogonal plane coordinate system which is defined by the prediction parameters $c_1$ and $c_2$. The prediction parameter candidate extraction example 100 illustrates a pattern in which an error straight line intersects with a region of the code book 21 and is parallel with any boundary side of the code book 21. In this example, some of these points exist on an error straight line 102.

In the positional relation of FIG. 7, the error straight line 102 is parallel with a boundary side which is parallel with a $c_2$ axis, among boundary sides of the code book 21. In this case, the candidate extraction unit 22 extracts points which have the minimum and identical distances from the error straight line, as candidates of the prediction parameter, among points which correspond to respective prediction parameters of the code book 21.

In FIG. 7, points which exist on the error straight line 102 are denoted by open circles, among points which are arranged as grid points. A plurality of points which are denoted by open circles have the minimum and identical distances from the error straight line (that is, zero) among all grid points. Accordingly, a prediction error becomes minimum and identical even when prediction of a signal of the central channel is performed by using any pair of values of the prediction parameters $c_1$ and $c_2$ which are represented by the points of these prediction parameter candidates 104-0 to 104-5. Accordingly, in the case of the example of FIG. 7, pairs of the prediction parameters $c_1$ and $c_2$ which are represented by the prediction parameter candidates 104-0 to 104-5 (referred to also as prediction parameter candidates 104 collectively or as a representative) are extracted from the code book 21, as candidates of the prediction parameter.

Here, in the prediction parameter candidate extraction processing, several patterns of extraction of candidates of a prediction parameter are prepared, and extraction of candidates of a prediction parameter is performed by selecting an extraction pattern in accordance with a positional relation between an error straight line on the above-mentioned plane and corresponding points of a prediction parameter of the code book 21.

Figure 8:
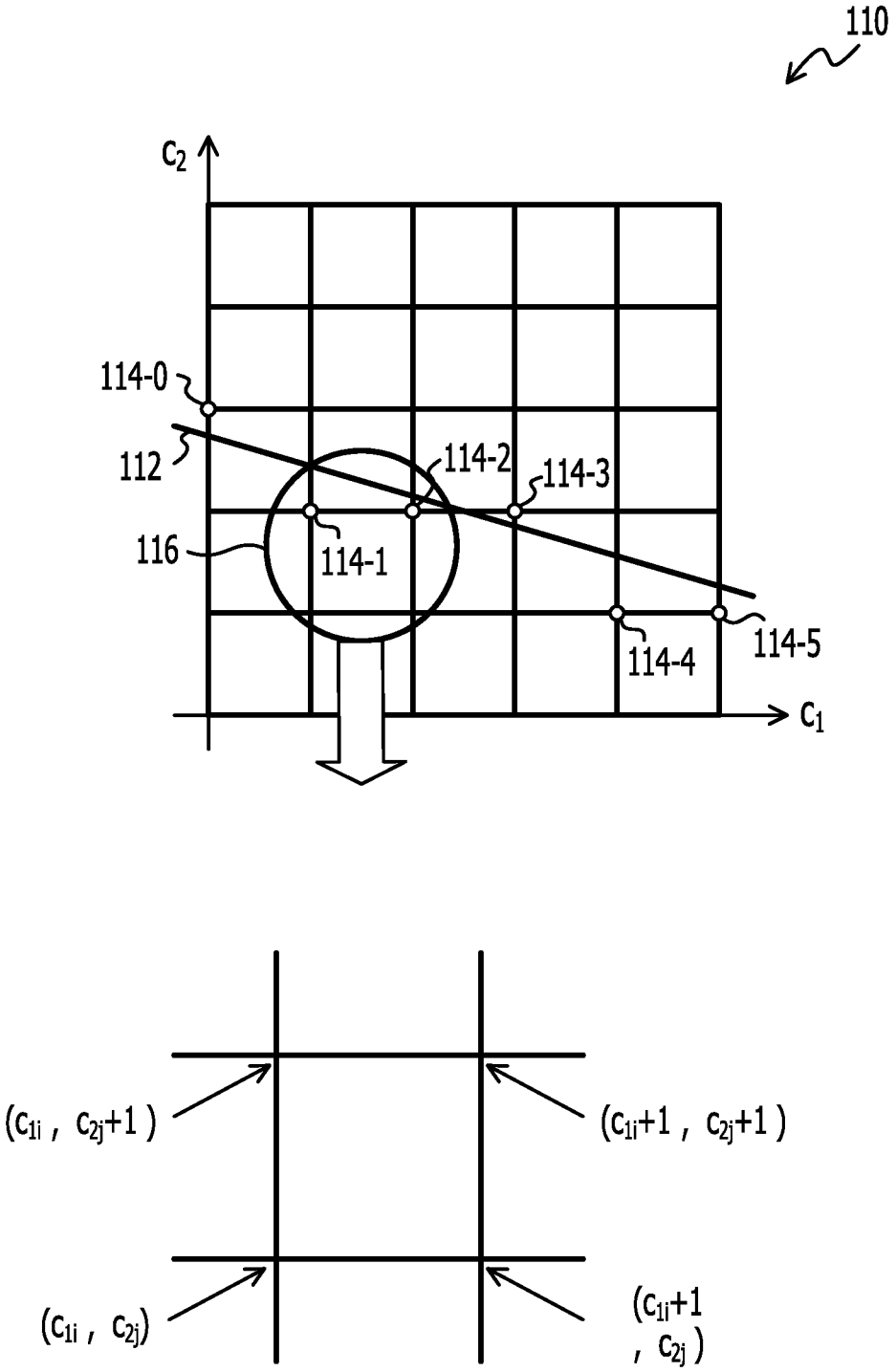
FIG. 8 illustrates an example of a pattern B of the prediction parameter candidate extraction.
Figure 9:
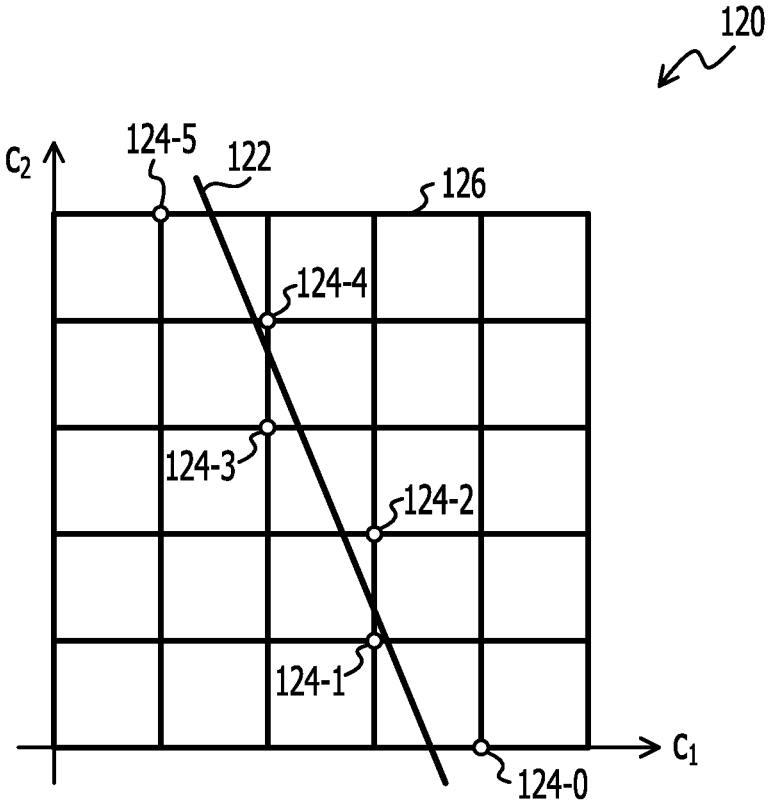
FIG. 9 illustrates an example of the pattern B of the prediction parameter candidate extraction.

FIGS. 8 and 9 illustrate another example of prediction parameter candidate extraction. A prediction parameter candidate extraction example 110 of FIG. 8 and a prediction parameter candidate extraction example 120 of FIG. 9 correspond to a pattern B which will be described later. The pattern B is a pattern of a case in which an error straight line is not parallel with any boundary sides of the code book 21, but the straight line intersects with a pair of opposed boundary sides in the code book 21.

In FIGS. 8 and 9, an aspect in which points which correspond to respective prediction parameters which are stored in the code book 21 are arranged as grid points, on a two-dimensional orthogonal plane coordinate system which is defined by the prediction parameters $c_1$ and $c_2$ is same as that of FIG. 7.

FIG. 8 illustrates an example of a case in which an error straight line 112 intersects with both of a pair of boundary sides which are parallel with the $c_2$ axis, between two pairs of opposed boundary sides of the code book 21. In this case, corresponding points of the code book 21 which are closest to the error straight line 112 are extracted as candidates 114-0 to 114-5 of a prediction parameter, for respective values of the prediction parameter $c_1$ in the code book 21. The candidates 114 of the prediction parameter which are thus extracted are values of the prediction parameter $c_2$ at which a prediction error which is used for prediction of a signal of the central channel becomes minimum, for respective values of the prediction parameter $c_1$.

As described above, regarding grid points on each side of a pair of boundary sides with which the error straight line 112 intersects, a grid point which is closest to the error straight line 112 is first selected and a prediction parameter 114 which corresponds to the selected grid point is extracted as a candidate. Further, regarding grid points existing on each line which is parallel with a pair of boundary sides, with which the error straight line intersects, and passes through grid points, as well, a grid point which is closest to the error straight line 112 is selected for every line, and a prediction parameter 114 which corresponds to the selected grid point is extracted as a candidate.

More specifically, a prediction parameter candidate 114 may be decided as described below. That is, as depicted in FIG. 8, it is assumed that the error straight line 112 is expressed as $c_2=l\times c_1$ in the prediction parameter candidate extraction example 110. Further, coordinates on four adjacent points among grid points expressing the code book 21 are defined as depicted in FIG. 8.

In this case, the following procedures (a) and (b) are performed while incrementing a value of a variable number i (i is an integer) by one.

(a) $c_1$j and $c_{2j+1}$ which satisfy $c_2 \le l\times c_{1i} \le c_{2j+1}$ are obtained (j is an integer).

(b) Cases are discriminated between the following (b1) and (b2) and candidates of prediction parameters for respective cases are extracted from the code book 21.

(b1) In a case of $|c_{2j}-l\times c_{1i}| \le |c_{2j+1}-l\times c_{1i}|$, a prediction parameter which corresponds to a grid point $(c_{1i},c_{2j})$ is extracted as a candidate from the code book 21.

(b2) In a case of $|c_{2j}-l\times c_{1i}| > |c_{2j+1}-l\times c_{1i}|$, a prediction parameter which corresponds to a grid point $(c_{1i},c_{2j+1})$ is extracted as a candidate from the code book 21.

FIG. 9 illustrates an example of a case in which an error straight line 122 intersects with both of a pair of boundary sides which are parallel with the $c_1$ axis, between two pairs of opposed boundary sides of the code book 21. In this case, corresponding points of the code book 21 which are closest to the error straight line 122 are extracted as candidates 124-0 to 124-5 of a prediction parameter, for respective values of the prediction parameter $c_2$ in the code book 21. The candidates 124 of the prediction parameter which are thus extracted are values of the prediction parameter $c_1$ at which a prediction error which is used for prediction of a signal of the central channel becomes minimum, for respective values of the prediction parameter $c_2$.

As described above, regarding grid points on each side of a pair of boundary sides with which the error straight line 122 intersects, a grid point which is closest to the error straight line 122 is first selected and a prediction parameter 124 which corresponds to the selected grid point is extracted as a candidate, in the example of FIG. 9 as well. Further, regarding grid points existing on each line which is parallel with a pair of boundary sides, with which the error straight line intersects, and passes through grid points, as well, a grid point which is closest to the error straight line 122 is selected for every line, and a prediction parameter 124 which corresponds to the selected grid point is extracted as a candidate. A prediction parameter candidate 124 may be also extracted in a similar fashion to the specific method which has been described in FIG. 8.

Figure 10:
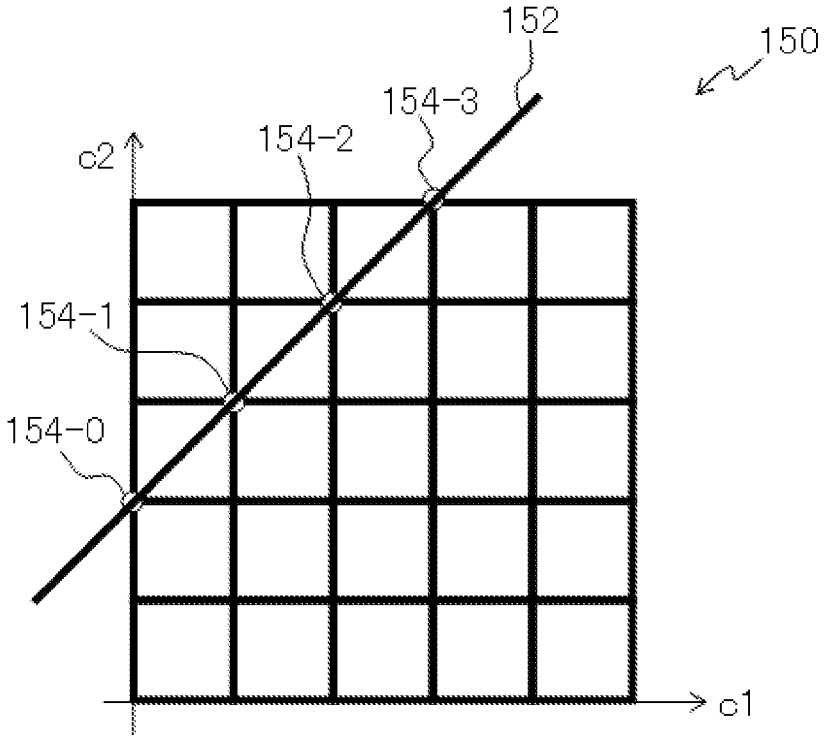
FIG. 10 illustrates an example of a pattern C of the prediction parameter candidate extraction.

In FIG. 10, an aspect in which points which correspond to respective prediction parameters which are stored in the code book 21 are arranged as grid points, on a two-dimensional orthogonal plane coordinate system which is defined by the prediction parameters $c_1$ and $c_2$ is same as that of FIG. 7.

A prediction parameter candidate extraction example 150 of FIG. 10 is an example in which an error straight line 152 is parallel with $c_2=c_1$ in the code book 21 and intersects with each grid point of the code book 21 and to which a pattern C is applied. In this case, corresponding points, which are on the error straight line 152, of the code book 21 are extracted as prediction parameter candidates 154-0 to 154-3. A prediction error is identical even when any of the prediction parameter candidates 154-0 to 154-3 which are thus extracted is selected to perform prediction of a signal of the central channel.

Figure 11:
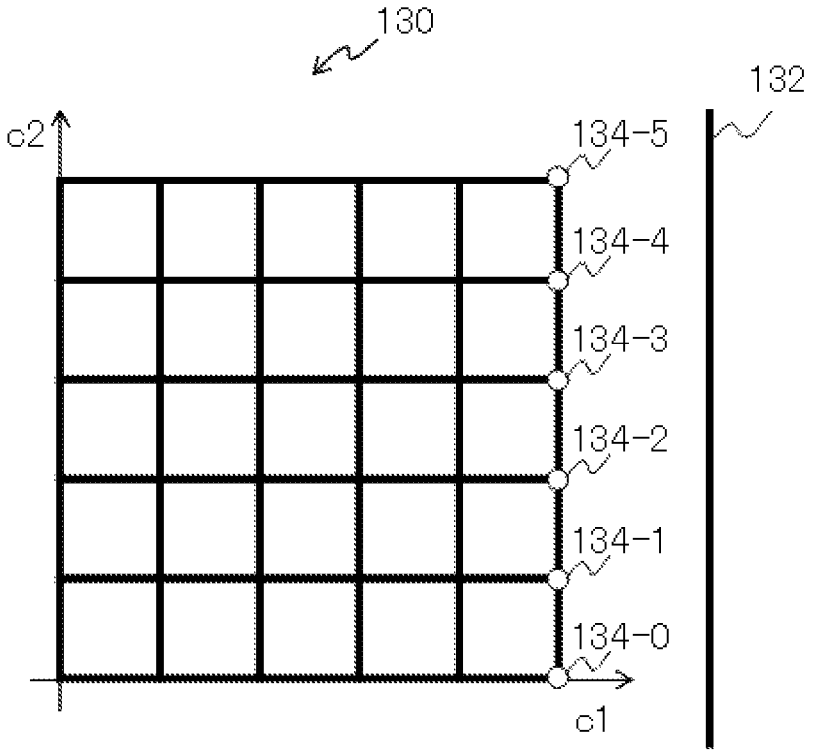
FIG. 11 illustrates an example of a pattern D of the prediction parameter candidate extraction.
Figure 12:
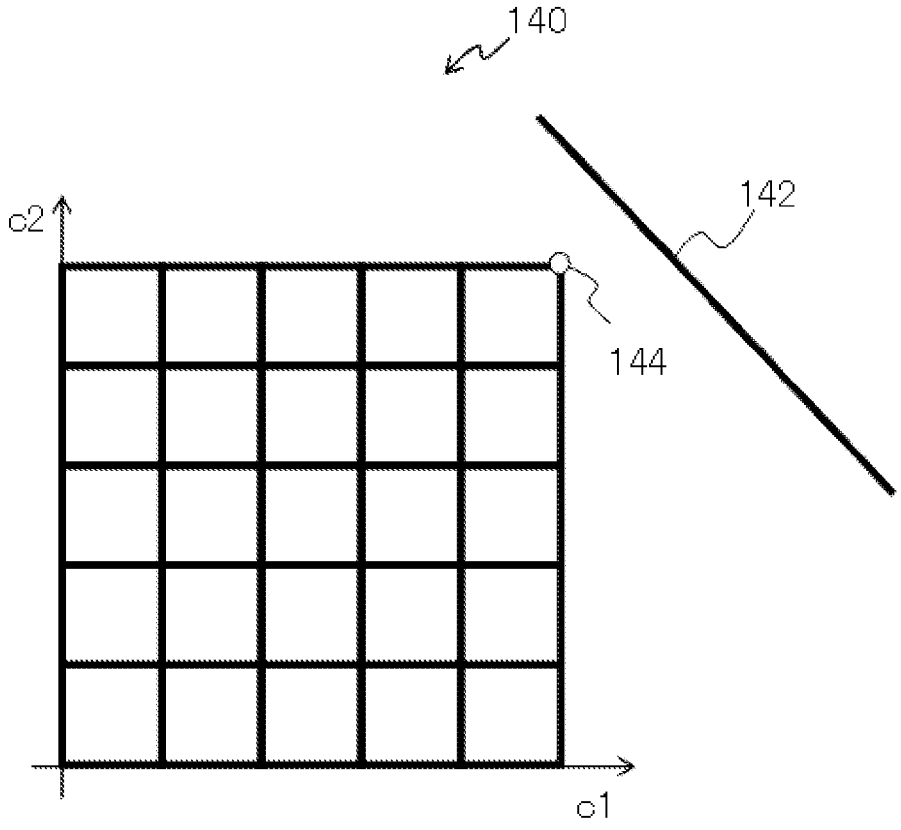
FIG. 12 illustrates an example of the pattern D of the prediction parameter candidate extraction.

In FIGS. 11 and 12, an aspect in which points which correspond to respective prediction parameters which are stored in the code book 21 are arranged as grid points, on a two-dimensional orthogonal plane coordinate system which is defined by the prediction parameters $c_1$ and $c_2$ is same as that of FIG. 7. This pattern is a pattern of a case in which an error straight line does not intersect with a region of the code book 21 but the error straight line is parallel with any boundary side of the code book 21.

A prediction parameter candidate extraction example 130 of FIG. 11 is an example in which an error straight line 132 does not intersect with a region of the code book 21 but the error straight line is parallel with a boundary side parallel with the $c_2$ axis and to which a pattern D is applied. In this case, corresponding points, which exist on a boundary side which is closest to the error straight line among boundary sides of the code book 21, of the code book 21 are extracted as candidates of a prediction parameter. A prediction error is identical even when any of prediction parameter candidates 134-0 to 134-5 which are thus extracted is selected to perform prediction of a signal of the central channel.

A prediction parameter candidate extraction example 140 of FIG. 12 is an example in which an error straight line 142 is not parallel with any of boundary sides of the code book 21 and, thus, to which the pattern D is not applied. In the case of the prediction parameter candidate extraction example 140, when prediction of a signal of the central channel is performed by using a prediction parameter of a corresponding point 144, on which an open circle is provided, among corresponding points of the code book 21, a prediction error becomes minimum, and when other prediction parameters are used, a prediction error becomes larger. Therefore, in this embodiment, embedding of other data into a prediction parameter is not performed in such case.

Figure 13:
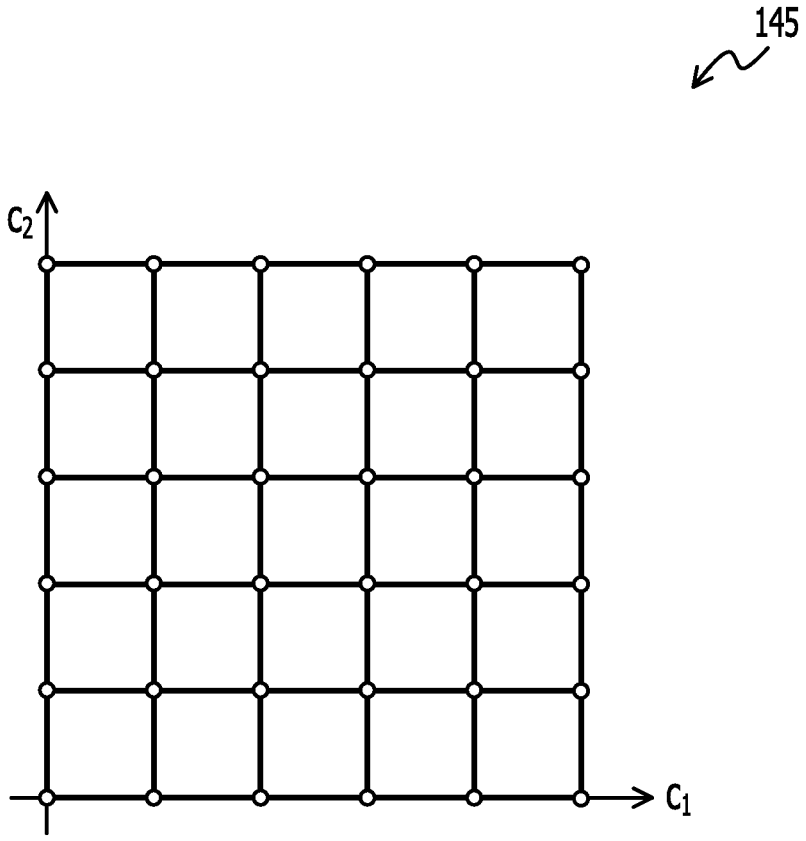
FIG. 13 illustrates an example of a pattern E of prediction parameter candidate extraction.

A prediction parameter candidate extraction example 145 of FIG. 13 is now described. The prediction parameter candidate extraction example 145 corresponds to a pattern E which will be described later. This pattern is a pattern of a case in which an error straight line is not decided in error straight line decision processing and of a case in which both of the signals of the right and left channels are zero.

In FIG. 13, an aspect in which points which correspond to respective prediction parameters which are stored in the code book 21 are arranged as grid points, on a two-dimensional orthogonal plane coordinate system which is defined by the prediction parameters $c_1$ and $c_2$ is same as that of FIG. 7. In this case, even when prediction of a signal of the central channel is performed by formula (1) by selecting any prediction parameter, the signal of the central channel is zero. Accordingly, all of the prediction parameters which are stored in the code book 21 are extracted as candidates in this case.

As described above, the candidate extraction unit 22 discriminates and uses prediction parameter candidate extraction processing of above-mentioned respective patterns depending on a positional relation between an error straight line and a region of the code book 21, so as to extract prediction parameter candidates.

Further, in the embodiment, the candidate extraction unit 22 extracts the number of prediction parameter candidates. The number of prediction parameter candidates is described below with reference to FIGS. 14 to 16. The number of prediction parameter candidates changes for every frame depending on the way of intersection between a straight line and the code book 21 at which a prediction error becomes minimum and roughness of a code book.

Figure 14:
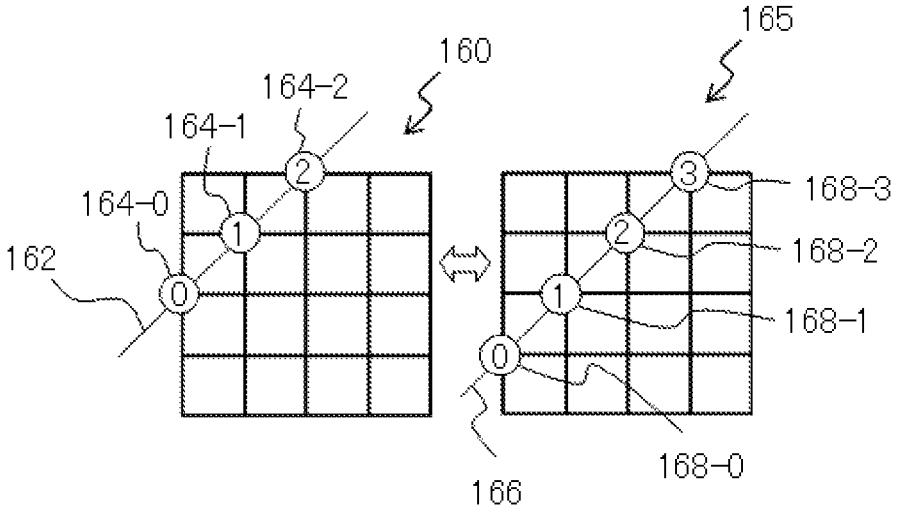
FIG. 14 illustrates an example in which the number of prediction parameter candidates changes in the pattern C.

FIG. 14 illustrates an example in which the number of prediction parameter candidates changes in the pattern D. As depicted in FIG. 14, the number of prediction parameter candidates changes depending on where error straight lines 162 and 166 intersect with the code book 21 as illustrated a prediction parameter candidate extraction example 160 and a prediction parameter candidate extraction example 165, in the pattern D. In the example of FIG. 14, the number of prediction parameter candidates 164 is three with respect to the error straight line 162, and the number of prediction parameter candidates 168 is four with respect to the error straight line 166.

Figure 15:
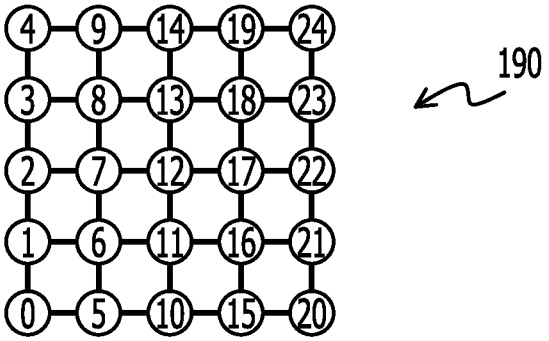
FIG. 15 illustrates an example of the pattern E.

FIG. 15 illustrates an example of a pattern E. As depicted in FIG. 15, all grid points on the code book 21 are extracted as prediction parameter candidates in the example of the pattern E. In the example of a prediction parameter candidate extraction example 190, 25 prediction parameters are extracted.

Figure 16:
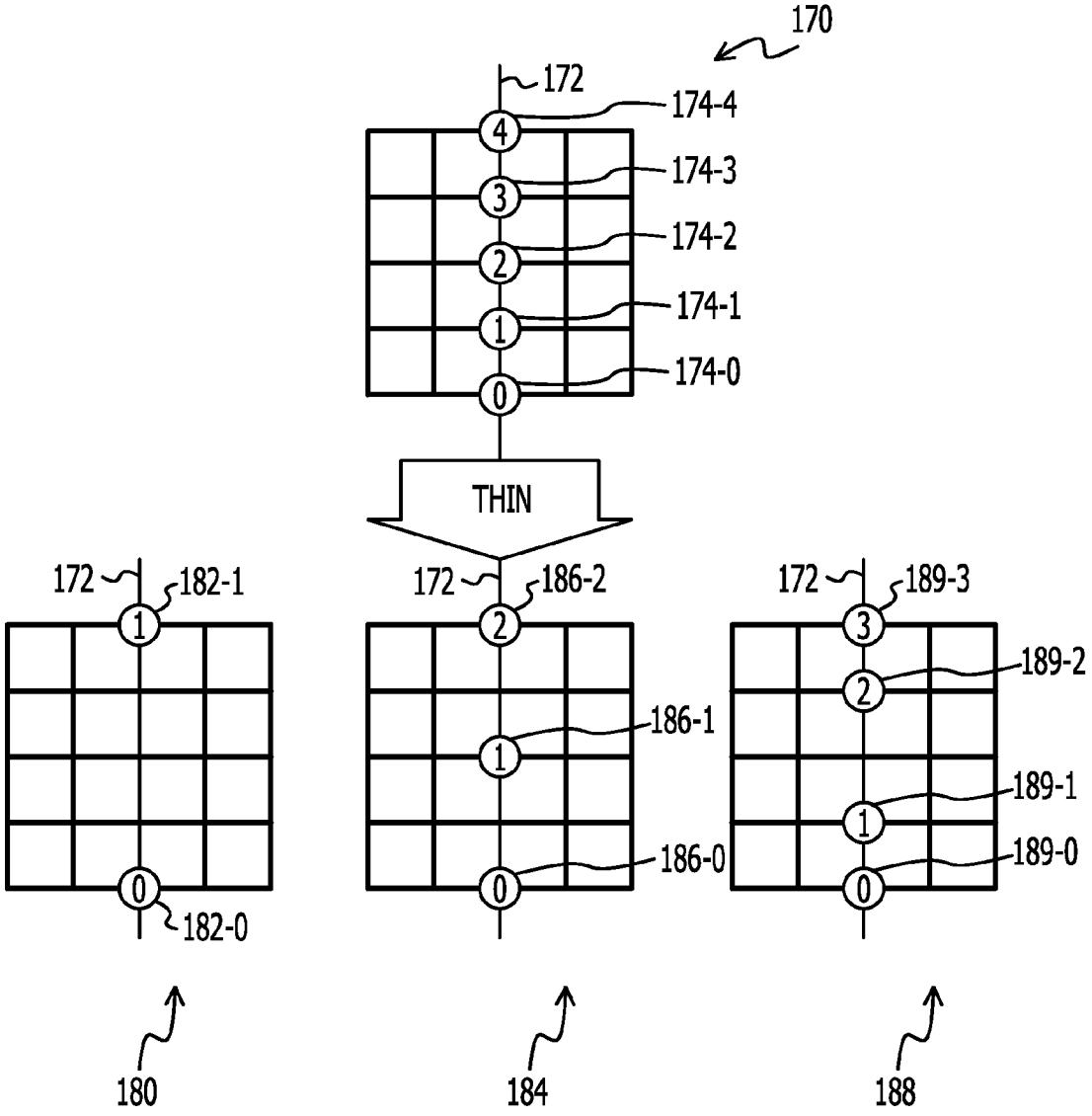
FIG. 16 illustrates a modification of the pattern A.

FIG. 16 illustrates a modification of the pattern A. As depicted in FIG. 16, in a prediction parameter candidate extraction example 170, an error straight line 172 is parallel with the $c_2$ axis and 5 prediction parameter candidates 175 are extracted. Prediction parameter candidate extraction examples 180, 184, and 188 are examples in which prediction parameter candidates 174 of the prediction parameter candidate extraction example 170 are thinned.

In the example of the prediction parameter candidate extraction example 180, prediction parameter candidates 174 of which the number of prediction parameter candidates N=5 (pieces) with respect to the error straight line 172 are thinned to be two pieces as prediction parameter candidates 182. In the example of the prediction parameter candidate extraction example 184, prediction parameter candidates 174 whose number has been 5 pieces with respect to the error straight line 172 are thinned to be three pieces as prediction parameter candidates 186. In the example of the prediction parameter candidate extraction example 188, prediction parameter candidates 174 whose number has been 5 pieces with respect to the error straight line 172 are thinned to be four pieces as prediction parameter candidates 189. The candidate extraction unit 22 outputs the number of prediction parameter candidates, which is thus extracted, to the embedded information conversion unit 24.

Figure 17:
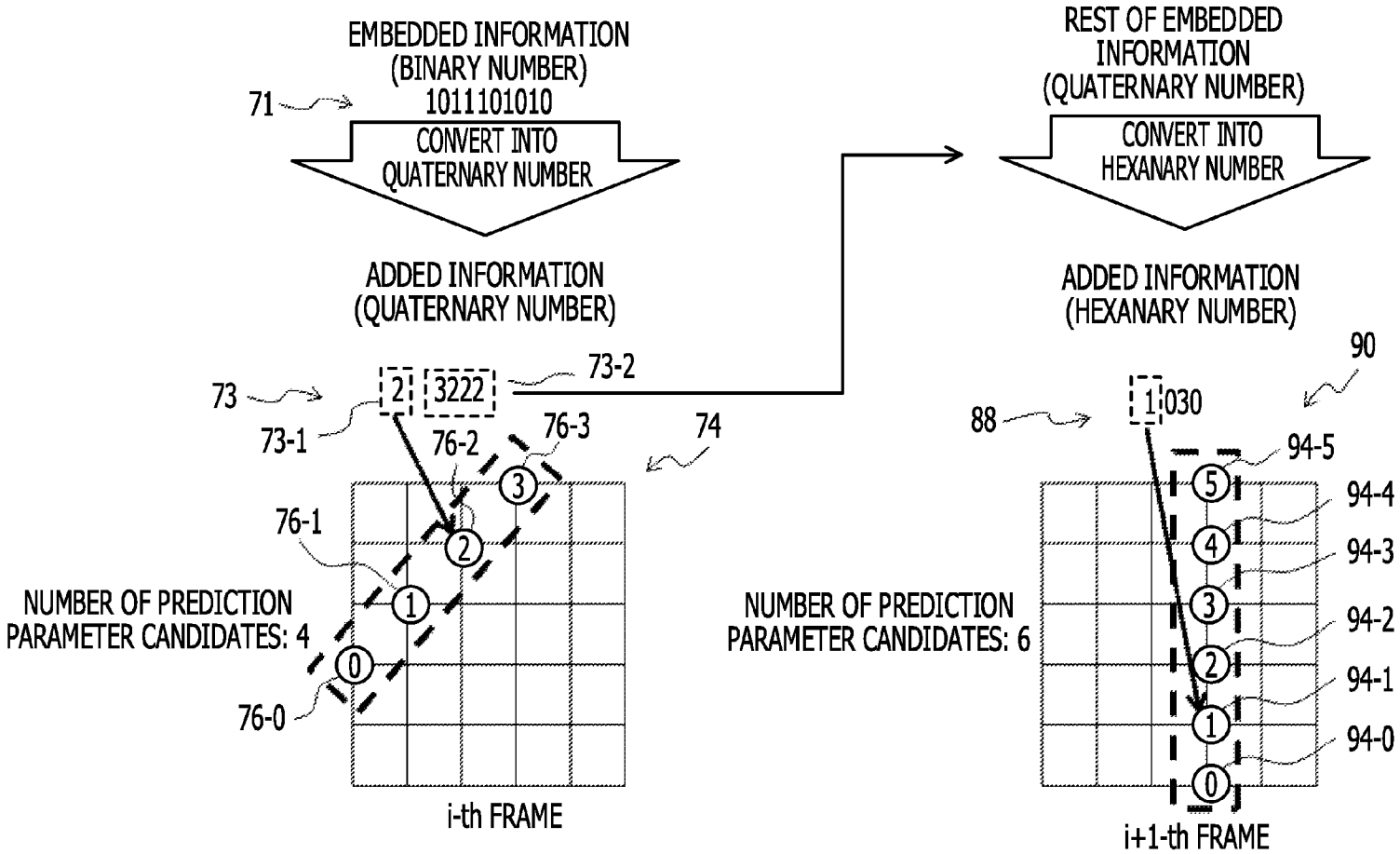
FIG. 17 illustrates an example of processing which is performed by a candidate extraction unit, the embedded information conversion unit, and a data embedding unit.

Subsequently, an example of conversion of embedded information which is performed by the embedded information conversion unit 24 is described with reference to FIGS. 17 and 18. As depicted in FIG. 17, in the embodiment, number base expression of embedded information is converted in accordance with the number N of prediction parameter candidates.

FIG. 17 illustrates an example of processing which is performed by the candidate extraction unit 22, the embedded information conversion unit 24, and the data embedding unit 23. In the example of FIG. 17, it is assumed that embedded information 71="1011101010". For example, it is assumed that the number of prediction parameter candidates 76 is 4 on the i-th frame (i is an arbitrary integer) as illustrated in a prediction parameter candidate extraction example 74. In this case, the candidate extraction unit 22 provides numbers 0 to N (prediction parameter candidates 76-0 to 76-3 in the example of FIG. 17), for example, to extracted parameter candidates. These numbers may be embedding values which respectively correspond to prediction parameter candidates, and may be provided in an ascending order of values of the parameters $c_1$ or $c_2$, for example. When information is embedded into a prediction parameter, this embedding value is embedded as embedded information. In the embodiment, the embedded information conversion unit 24 converts the embedded information 71 into a number base based on the number N of prediction parameter candidates.

As depicted in FIG. 17, the embedded information conversion unit 24 converts the embedded information 71 into a quaternary number so as to calculate embedded information 73="23222". The embedded information conversion unit 24 extracts part which does not exceed the number N of parameter candidates from the converted embedded information 73 as the embedded information 73-1, for example, so as to set the part as embedded information. In this case, embedded information="2". Therefore, the data embedding unit 23 sets the coordinates $c_1$, $c_2$ of a grid point, which corresponds to a prediction parameter candidate 76-2 having a corresponding embedding value, on the code book 21 as a prediction parameter of the i-th frame so as to embed the embedded information 73-1.

Subsequently, the candidate extraction unit 22 extracts prediction parameter candidates 94 on the (i+1)-th frame, as a prediction parameter candidate extraction example 90. As illustrated in the prediction parameter candidate extraction example 90, the number of prediction parameter candidates N=6 (pieces) in this example. The embedded information conversion unit 24 converts embedded information 73-2="3222" (quaternary number) into a hexanary number on the basis of the extracted number of prediction parameters N=6. In this case, converted embedded information 88="1030" (hexanary number). The embedded information conversion unit 24 extracts a number which does not exceed "6" from a higher order digit in the embedded information 88 so as to set embedded number 88-1="1" as embedded information. The data embedding unit 23 sets the coordinates $c_1$, $c_2$ of a grid point, which corresponds to "1", of the prediction parameter candidate 94-1 on the code book 21 as a prediction parameter so as to embed the embedded information 88-1.

Figure 18:
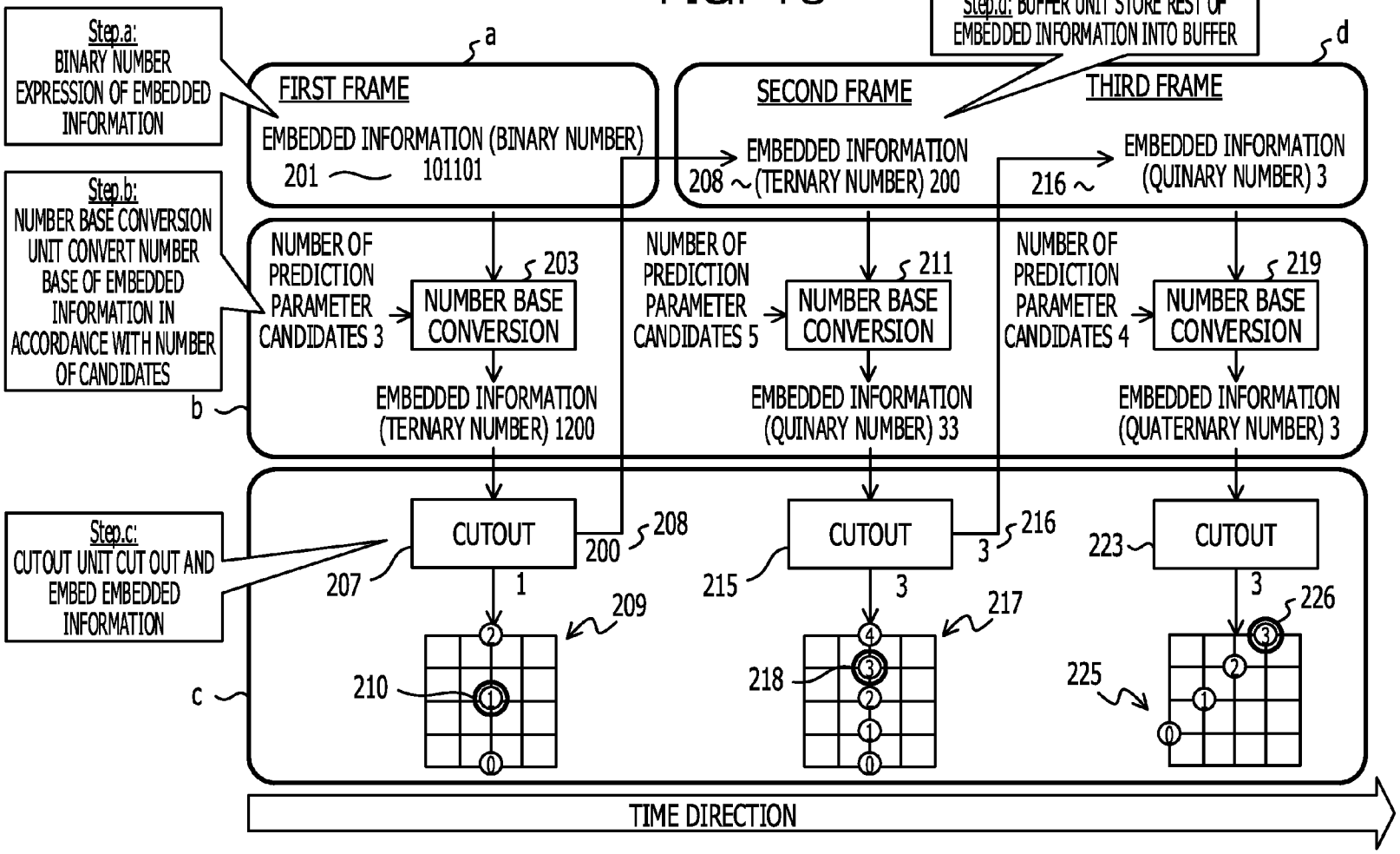
FIG. 18 illustrates another example of processing which is performed by the candidate extraction unit, the embedded information conversion unit, and the data embedding unit.

FIG. 18 illustrates another example of processing which is performed by the candidate extraction unit 22, the embedded information conversion unit 24, and the data embedding unit 23. In the example of FIG. 18, it is assumed that embedded information 201="101101" on the first frame, for example, as illustrated in step a. In this case, the embedded information conversion unit 24 acquires the number of prediction parameter candidates N=3 from the candidate extraction unit 22 as illustrated in step b. At this time, the embedded information conversion unit 24 converts the embedded information 201 into a ternary number to set the embedded information 201 to "1200" as number base conversion 203. As illustrated in step c, the embedded information conversion unit 24 cuts out "1" which does not exceed N=3 from a higher order digit of the converted embedded information in cutout 207. The data embedding unit 23 sets the coordinates of a prediction parameter 210 which corresponds to "1", as a prediction parameter as illustrated in a prediction parameter selection example 209 which is extracted in the candidate extraction unit 22 so as to embed part of the embedded information.

As illustrated in steps d and b, the embedded information conversion unit 24 converts embedded information 208="200" into a quinary number "33" on the basis of the number of prediction parameter candidates N=5 which is extracted by the candidate extraction unit 22, through number base conversion 211 on the second frame, for example. As illustrated in step c, the embedded information conversion unit 24 cuts out "3" which does not exceed N=5 from a higher order digit of the quinary number "33" in cutout 215. The data embedding unit 23 sets the coordinates of a prediction parameter 218 which corresponds to "3", as a prediction parameter as illustrated in a prediction parameter selection example 217 which is extracted in the candidate extraction unit 22 so as to embed embedded information.

As illustrated in steps d and b, the embedded information conversion unit 24 converts embedded information 216="3" into a quaternary number "3" on the basis of the number of prediction parameter candidates N=4 which is extracted by the candidate extraction unit 22, through number base conversion 219 on the third frame, for example. As illustrated in step c, the embedded information conversion unit 24 cuts out "3" which does not exceed N=4 from a higher order digit of the quaternary number "3" in cutout 223. The data embedding unit 23 sets the coordinates of a prediction parameter candidate 226 which corresponds to "3", as a prediction parameter as illustrated in a prediction parameter selection example 225 which is extracted in the candidate extraction unit 22 so as to embed embedded information.

Figure 19:
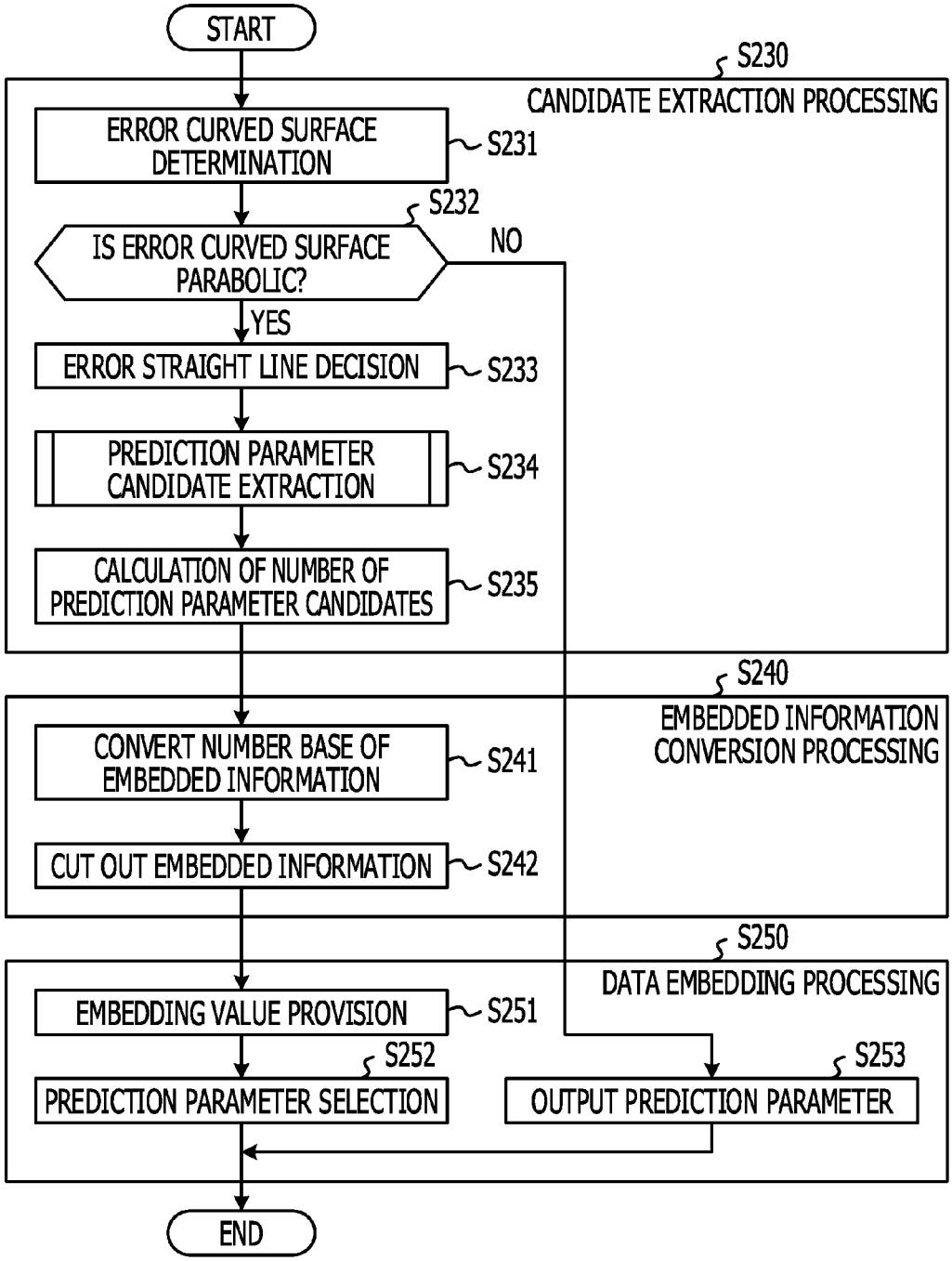
FIG. 19 is a flowchart illustrating an example of a data embedding method.
Figure 20:
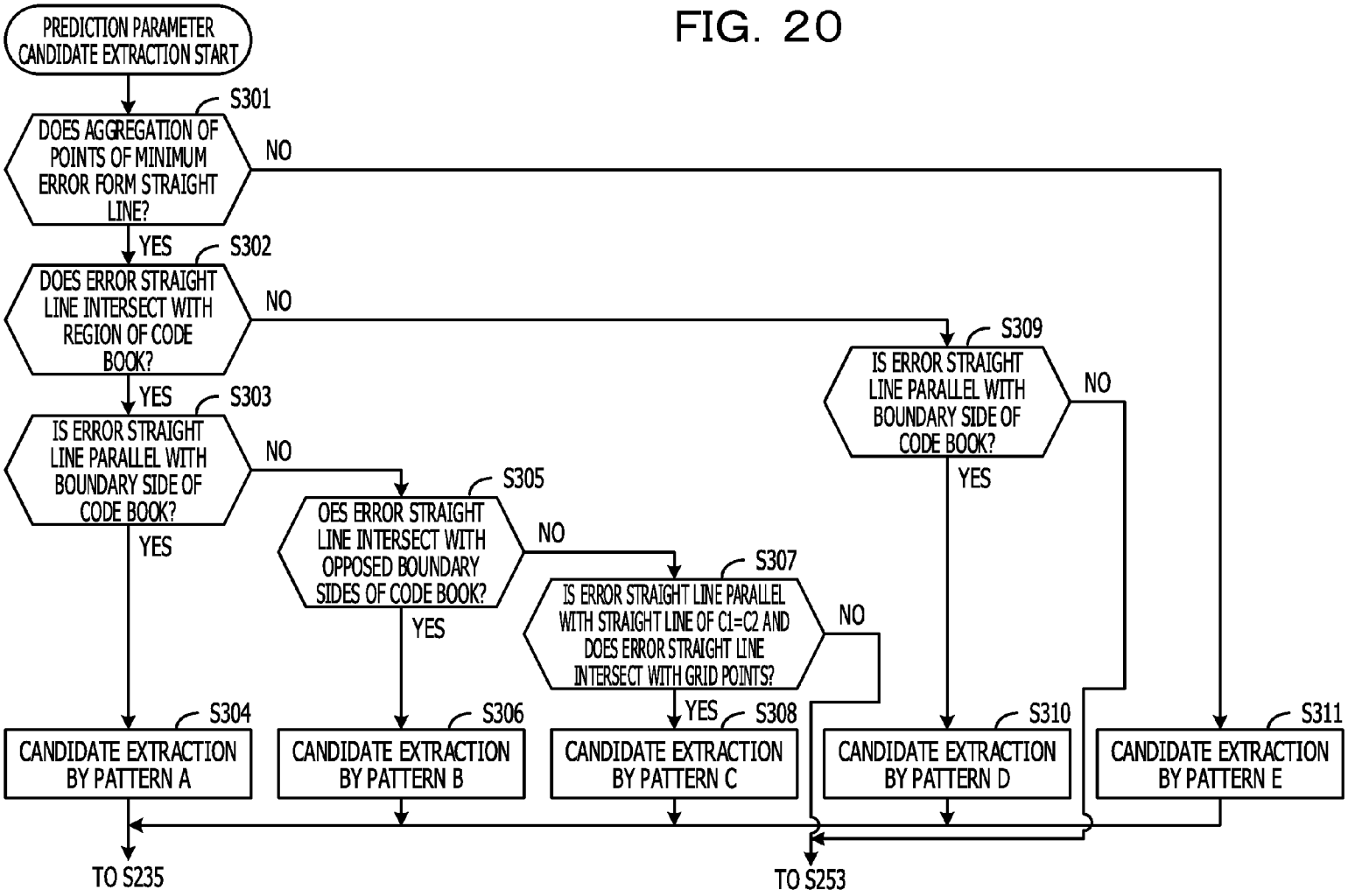
FIG. 20 is a flowchart illustrating details of prediction parameter candidate extraction processing.

The above-described processing is further described with reference to flowcharts. FIGS. 19 and 20 illustrate an example of a data embedding method according to the embodiment. In FIG. 19, the candidate extraction unit 22 first performs candidate extraction processing in S230. As described above, this processing extracts a plurality of candidates of a prediction parameter of which errors with respect to the prediction parameter, which is acquired by the prediction encoding unit 15 of the encoder device 10, are respectively within a predetermined threshold value, from the code book 21.

The candidate extraction unit 22 first performs error curved surface determination (S231). Subsequently, in S232, the candidate extraction unit 22 performs processing for determining whether or not a shape of the error curved surface which is determined in the error curved surface determination processing of S231 is parabolic (S232). When the candidate extraction unit 22 determines that the shape of the error curved surface is parabolic (S232: YES), the candidate extraction unit 22 goes to processing of S233 to proceed the processing for data embedding. On the other hand, when the candidate extraction unit 22 determines that the shape of the error curved surface is not parabolic (is elliptical) (S232: NO), the candidate extraction unit 22 goes to processing of S234. In this case, data embedding is not performed.

In S233, the candidate extraction unit 22 performs error straight line decision processing. As described above, aggregation of points forms a straight line when the error curved surface is parabolic. Here, when the error curved surface is elliptical, the number of points with a minimum prediction error is one and thus, a straight line is not formed. Accordingly, the above-described determination processing of S232 may be also called processing for determining whether or not aggregation of points with the minimum predication error forms a straight line.

In S234, the candidate extraction unit 22 performs prediction parameter candidate extraction processing. This processing extracts candidates of a prediction parameter from the code book 21 on the basis of the error straight line which is obtained through the processing of S233. Details of the processing of S234 will be described later.

Subsequently, the candidate extraction unit 22 performs calculation processing of the number N of prediction parameter candidates in S235. In this processing, the candidate extraction unit 22 calculates the number=N of candidates of a prediction parameter, which is extracted in the prediction parameter candidate extraction processing of S234. For example, the number of open circles which are extracted as candidates of a prediction parameter is 6 in the example of FIG. 7, N=6 is obtained. The candidate extraction unit 22 performs the above-described processing from S231 to S235 as the candidate extraction processing of S230.

When the candidate extraction processing (S230) performed by the candidate extraction unit 22 is completed, the embedded information conversion unit 24 performs processing for converting embedded information. That is, the embedded information conversion unit 24 converts embedded information into a base-n number in accordance with the number N, which is extracted, of candidates of a prediction parameter, as described with reference to FIGS. 17 and 18 (S241). Further, the embedded information conversion unit 24 cuts out a number which does not exceed N from a higher order digit of the embedded information which is converted into the base-n number (S242).

When the embedded information conversion processing (S240) performed by the embedded information conversion unit 24 is completed, the data embedding unit 23 subsequently performs data embedding processing in S250. This processing selects a prediction parameter which is a result of prediction coding performed by the prediction encoding unit 15, from extracted candidates of a prediction parameter, on the basis of the embedded information which is cut out through the processing of S242. Through this processing, embedded information is embedded into the corresponding prediction parameter.

Subsequently, the data embedding unit 23 performs embedding value provision processing in S251. This processing provides an embedding value with respect to each of candidates, which are extracted in the prediction parameter candidate extraction processing of S234, of a prediction parameter, in accordance with the above-described predetermined rule which corresponds to the number N of prediction parameters. Then, the data embedding unit 23 performs prediction parameter selection processing in S252. This processing refers to a bit string which corresponds to a number, which does not exceed N, in the embedded information, which is converted into the base-n number, and selects a candidate, to which an embedding value which accords with the base-n number of this bit string is provided, of a prediction parameter. Further, this processing outputs the selected candidate to the multiplexing unit 16 of the encoder device 10 (S252).

On the other hand, when it is determined that the shape of the error curved surface is not parabolic (is elliptical) through the above-described determination processing in S232 (S232: NO), the data embedding unit 23 performs processing of S253. This processing outputs a pair of values of the prediction parameters $c_1$ and $c_2$ which is outputted from the prediction encoding unit 15 of the encoder device 10 directly to the multiplexing unit 16 so as to multiplex the pair to coded data. Accordingly, data embedding is not performed in this case. When the processing of S253 is completed, the control processing of FIG. 19 is ended. Through the execution of the above-described control processing in the data embedding device 20, other data is embedded into coded data which is generated by the encoder device 10.

FIG. 20 is a flowchart illustrating details of the prediction parameter candidate extraction processing of S234 in FIG. 19. As illustrated in FIG. 20, the candidate extraction unit 22 performs processing for determining whether or not aggregation of points of a minimum error form a straight line (S301). As described above, when both of the r vector and the l vector are zero vectors, aggregation of points of the minimum error does not form a straight line. In the determination processing of S301, whether or not to correspond to this case is determined.

In S301, when the candidate extraction unit 22 determines that at least one of the r vector and the l vector is not a zero vector and accordingly, aggregation of points of the minimum error forms a straight line (S301: YES), the candidate extraction unit 22 goes to processing of S302. On the other hand, when the candidate extraction unit 22 determines that both of the r vector and the l vector are zero vectors and accordingly, aggregation of points of the minimum error does not form a straight line (S301: NO), the candidate extraction unit 22 goes to processing of S311.

In S302, the candidate extraction unit 22 performs processing for determining whether or not the error straight line which is obtained through the error straight line decision processing of S233 of FIG. 19 intersects with a region of the code book 21. Here, a region of the code book 21 is a circumscribed rectangular region which includes points which correspond to respective prediction parameters which are stored in the code book 21 on a plane which is defined by the prediction parameters $c_1$ and $c_2$. When the candidate extraction unit 22 determines that the error straight line intersects with a region of the code book 21 (S302: YES), the candidate extraction unit 22 goes to processing of S303, and when the candidate extraction unit 22 determines that the error straight line does not intersect with a region of the code book 21 (S302: NO), the candidate extraction unit 22 goes to processing of S309.

In S303, the candidate extraction unit 22 performs processing for determining whether or not the error straight line is parallel with any of boundary sides of the code book 21. Here, boundary sides of the code book 21 are rectangular sides which define the above-mentioned region of the code book 21. A determination result of this determination processing becomes Yes, when a formula of the error straight line is expressed as above-mentioned formula (5) or formula (6). On the other hand, when the formula of the error straight line is expressed as above-mentioned formula (7), that is, a proportion of sizes of signals of the left channel and the right channel has an invariable value during a predetermined period, it is determined that the error straight line is not parallel with any of the boundary sides of the code book 21 and the determination result becomes No.

When the candidate extraction unit 22 determines that the error straight line is parallel with any of the boundary sides of the code book 21 in the determination processing of S303 (S303: YES), the candidate extraction unit 22 goes to processing of S304. On the other hand, when the candidate extraction unit 22 determines that the error straight line is not parallel with any of the boundary sides (S303: NO), the candidate extraction unit 22 goes to processing of S305.

Subsequently, the candidate extraction unit 22 performs prediction parameter candidate extraction processing by the pattern A in S304 and then the candidate extraction unit 22 goes to the processing of S235 of FIG. 19. This prediction parameter candidate extraction processing of the pattern A is a pattern which has been described with reference to FIG. 7.

On the other hand, the candidate extraction unit 22 performs processing for determining whether or not the error straight line intersects with both of a pair of opposed boundary sides in the code book 21 in S305. Here, when the candidate extraction unit 22 determines that the error straight line intersects with both of a pair of opposed boundary sides of the code book 21 (S305: YES), the candidate extraction unit 22 goes to processing of S306 to perform prediction parameter candidate extraction processing by the pattern B. Then, the candidate extraction unit 22 goes to the processing of S235 of FIG. 19.

On the other hand, when the candidate extraction unit 22 determines that the error straight line does not intersect with both of a pair of opposed boundary sides of the code book 21 in the determination processing of S305 (S305: NO), the candidate extraction unit 22 determines whether or not the error straight line is parallel with a straight line of $c_2=c_1$ and intersects with grid points (S307).

When the determination of S307 is YES, the candidate extraction unit 22 goes to processing of S308 to perform prediction parameter candidate extraction processing by the pattern C. This pattern C is a pattern which has been described with reference to FIG. 10. Then, the candidate extraction unit 22 goes to the processing of S235 of FIG. 19. When the determination of S307 is NO, the candidate extraction unit 22 goes to the processing of S253 of FIG. 19.

Meanwhile, when the determination result of S302 is NO, determination processing of S309 is performed. The candidate extraction unit 22 performs processing for determining whether or not the error straight line is parallel with the above-described boundary side of the code book 21, in S309. This determination processing is identical to the determination processing of S303. Here, when the candidate extraction unit 22 determines that the error straight line is parallel with the boundary side of the code book 21 (S309: YES), the candidate extraction unit 22 goes to processing of S310 to perform prediction parameter candidate extraction processing by the pattern D and then goes to the processing of S235 of FIG. 19. The pattern D is a pattern which has been described with reference to FIG. 11. On the other hand, when the candidate extraction unit 22 determines that the error straight line is not parallel with the boundary side of the code book 21 (S309: NO), the candidate extraction unit 22 goes to the processing of S253 of FIG. 19.

Meanwhile, when the determination result of S301 is NO, the candidate extraction unit 22 performs prediction parameter candidate extraction processing by the pattern E in S311 and then goes to the processing of S253 of FIG. 19. The prediction parameter candidate extraction processing of the pattern E is a pattern which has been described with reference to FIG. 13. The prediction parameter candidate extraction processing illustrated in FIG. 20 is performed as described thus far. Embedding of embedded information by the data embedding device 20 is thus performed.

Figure 21:
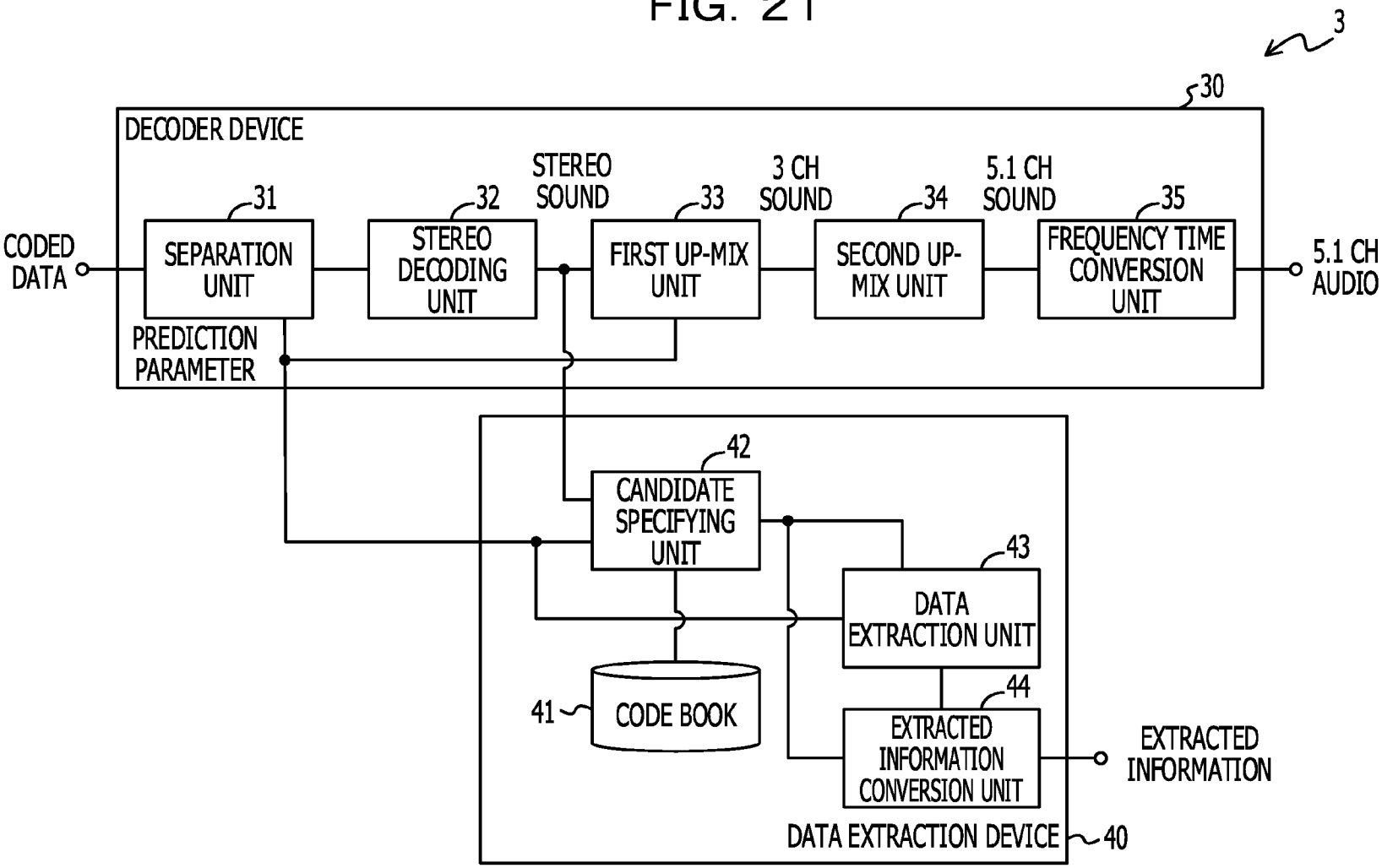
FIG. 21 is a block diagram illustrating the configuration of a decode system.

A decode system 3 according to the embodiment is described below with reference to FIGS. 21 to 27. FIG. 21 is a block diagram illustrating the configuration of the decode system 3 of the embodiment, and FIG. 22 is a block diagram illustrating the configuration of an extracted information conversion unit 44.

As depicted in FIG. 21, the decode system 3 includes the decoder device 30 and a data extraction device 40. The decoder device 30 includes a separation unit 31, a stereo decoding unit 32, the first up-mix unit 33, a second up-mix unit 34, and a frequency time conversion unit 35. The data extraction device 40 includes a code book 41, a candidate specifying unit 42, a data extraction unit 43, and the extracted information conversion unit 44. The extracted information conversion unit 44 includes an extracted information buffer unit 45, a number base conversion unit 46, and a coupling unit 47.

Figure 22:
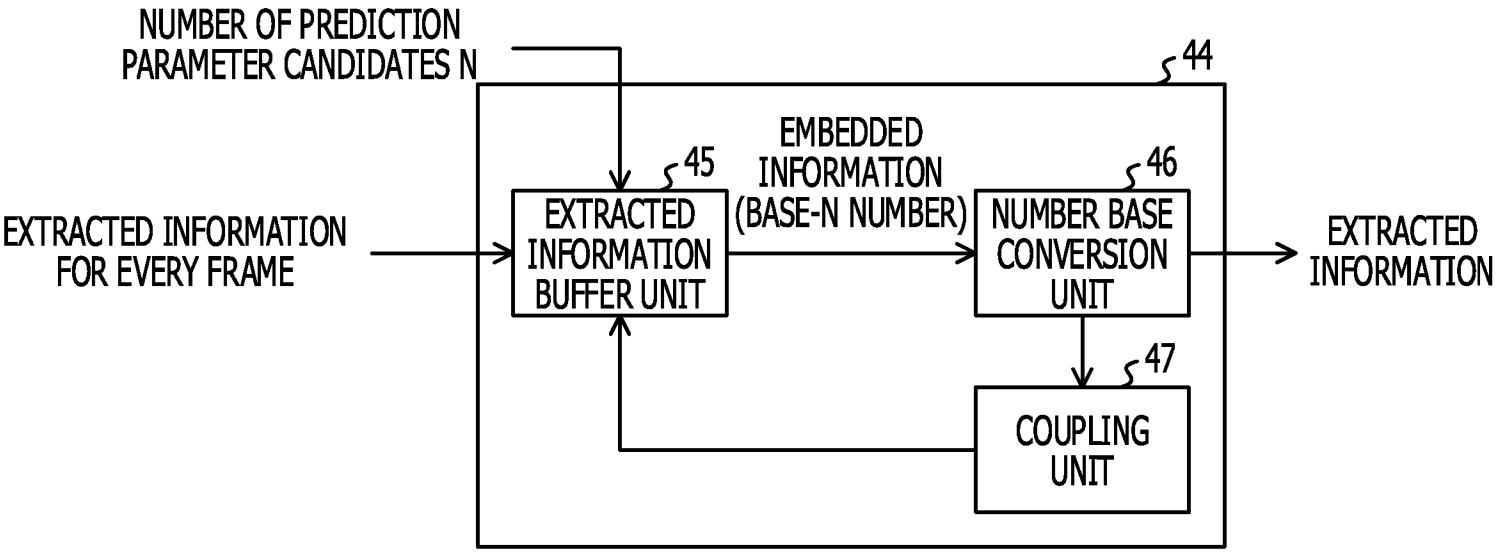
FIG. 22 is a block diagram illustrating the configuration of an extracted information conversion unit.

Constituent elements included in the decode system 3 depicted in FIGS. 21 and 22 are respectively formed as independent circuits. Alternatively, the elements of the decode system 3 may be respectively implemented as an integrated circuit in which part or all of these constituent elements are integrated. Further, these constituent elements may be function modules which are realized by a program which is executed on an arithmetic processing device which is included in each of the elements of the decode system 3.

Coded data which is an output of the encode system 1 of FIG. 1 is inputted into the decoder device 30, and the decoder device 30 restores an original audio signal of a time region of 5.1 channels from this coded data and outputs the original audio signal. The data extraction device 40 extracts information which is embedded by the data embedding device 20 from this coded data and outputs the extracted information.

The separation unit 31 separates multiplexed coded data, which is an output of the encode system 1 of FIG. 1, into a prediction parameter and coded data which is outputted from the stereo encoding unit 14, in accordance with an arrangement order in the multiplexing which is used in the multiplexing unit 16. The stereo decoding unit 32 decodes coded data which is received from the separation unit 31 so as to restore stereo frequency signals of two channels in total which are the left channel and the right channel.

The first up-mix unit 33 up-mixes stereo frequency signals which are received from the stereo decoding unit 32 by using a prediction parameter which is received from the separation unit 31, in accordance with the above-described method of FIG. 3, so as to restore frequency signals of three channels in total which are the left, central, and right channels.

The second up-mix unit 34 up-mixes frequency signals of three channels which are received from the first up-mix unit 33, so as to restore frequency signals of 5.1 channels in total which are a left forward channel, a central channel, a right forward channel, a left backward channel, a right backward channel, and a low-frequency exclusive channel.

The frequency time conversion unit 35 performs frequency time conversion which is reverse conversion of time frequency conversion performed by the time frequency conversion unit 11, with respect to frequency signals of 5.1 channels which are received from the second up-mix unit 34, so as to restore and output an audio signal of a time region of 5.1 channels.

In the code book 41 of the data extraction device 40, a plurality of candidates of a prediction parameter are prestored. This code book 41 is identical to the code book 21 which is included in the data embedding device 20. Here, the data extraction device 40 includes the code book 41 in the configuration of FIG. 21, but alternatively, a code book which is included in the decoder device 30 may be used so as to obtain a prediction parameter which is to be used in the first up-mix unit 33.

The candidate specifying unit 42 specifies candidates, which are extracted by the candidate extraction unit 22, of a prediction parameter from the code book 41 on the basis of a prediction parameter which is a result of prediction coding and the above-mentioned signals of other two channels. More specifically, the candidate specifying unit 42 specifies candidates, which are extracted by the candidate extraction unit 22, of a prediction parameter from the code book 41 on the basis of a prediction parameter which is received from the separation unit 31 and stereo frequency signals which are restored by the stereo decoding unit 32.

The data extraction unit 43 extracts data which is embedded into coded data by the data embedding unit 23, from candidates of a prediction parameter which are specified by the candidate specifying unit 42, on the basis of the data embedding rule which is used in embedding of information performed by the data embedding unit 23.

The extracted information conversion unit 44 converts extracted information which is extracted by the data extraction unit 43 into a binary number on the basis of the number N of candidates of a prediction parameter in a corresponding frame, thus restoring extracted information. The extracted information buffer unit 45 is a storage device which temporarily stores extracted information which has been embedded for every frame and is extracted and the number N of candidates of the prediction parameter so as to output the extracted information and the number N to the number base conversion unit 46 in sequence. The number base conversion unit 46 converts extracted information which is inputted from the extracted information buffer unit 45 into a number base based on the number N of prediction parameter candidates of a frame from which the extracted information is extracted, or a binary number, for example. The coupling unit 47 couples extracted information which is stored in the extracted information buffer unit 45 or a number base which is converted by the number base conversion unit 46.

Figure 23:
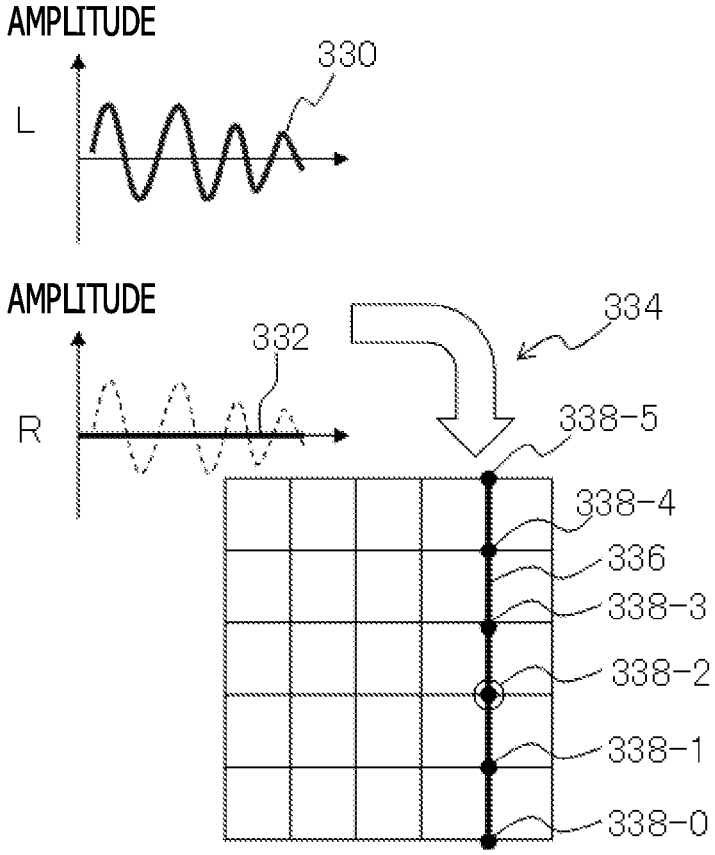
FIG. 23 illustrates an example in which an error straight line is parallel with a $c_2$ axis.
Figure 24:
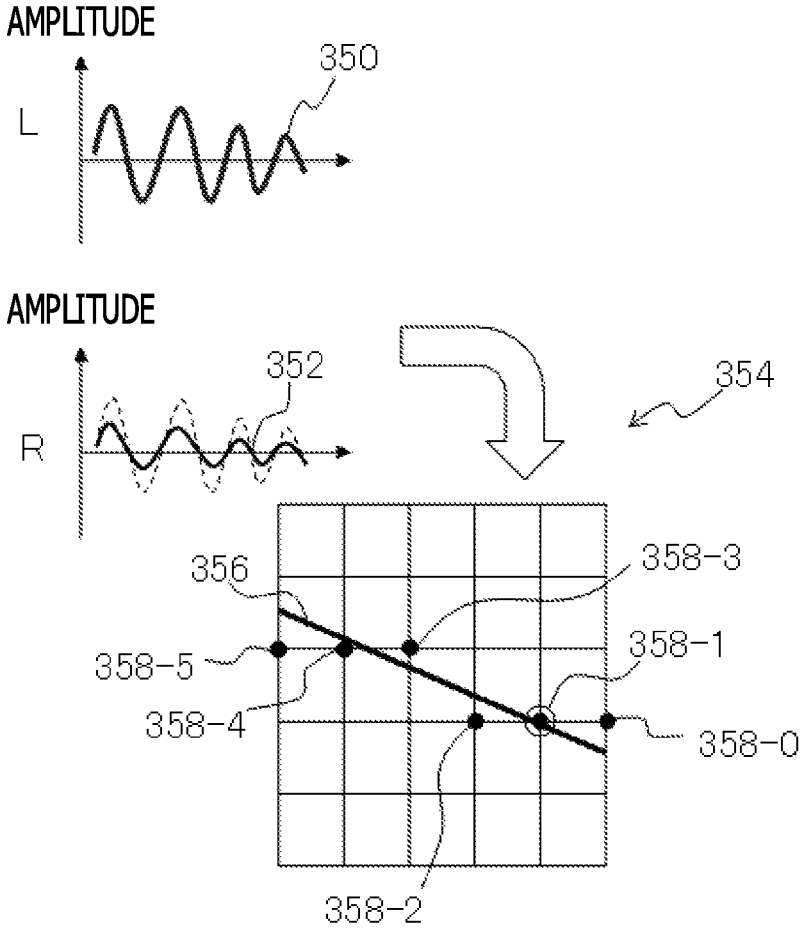
FIG. 24 illustrates an example in which an error straight line intersects with two opposed sides of a code book.

Here, processing of the candidate specifying unit 42 is further described with reference to FIGS. 23 and 24. FIG. 23 illustrates an example in which an error straight line is parallel with $c_2$. FIG. 24 illustrates an example in which an error straight line intersects with two opposed sides of the code book 41.

As depicted in FIG. 23, one signal of the left channel of a stereo signal is expressed as an audio signal 330, while an error straight line is parallel with the $c_2$ axis when amplitude of a signal of the right channel is "0" as an audio signal 332. That is, an error straight line 336 is parallel with the $c_2$ axis as a prediction parameter candidate extraction example 334. In this case, prediction parameter candidates 338-0 to 338-5 are extracted and the prediction parameter candidate 338-2, for example, among these candidates is extracted as a point corresponding to a prediction parameter.

As depicted in FIG. 24, when an audio signal 350 of the left channel of a stereo signal is proportional to an audio signal 352 of the right channel, inclination of an error straight line 356 is decided depending on a ratio between the audio signal 350 and the audio signal 352. As illustrated in a prediction parameter candidate extraction example 354, prediction parameter candidates 358-0 to 358-5 are extracted by extracting grid points which are close to the error straight line 356. Among these candidates, the prediction parameter candidate 358-1, for example, is extracted as a point corresponding to a prediction parameter.

Subsequently, the processing of the extracted information buffer unit 45 is further described. FIG. 25 illustrates an example of a buffer information 370 held by the extracted information buffer unit 45. The buffer information 370 includes an embedding value and the number of candidates as an item 372. In the example of the buffer information 370, examples of the first to third frames are illustrated. For example, an embedding value of the first frame is "1" and the number of candidates is "3". An embedding value of the second frame is "3" and the number of candidates is "5". An embedding value of the third frame is "3" and the number of candidates is "4".

Figure 26:
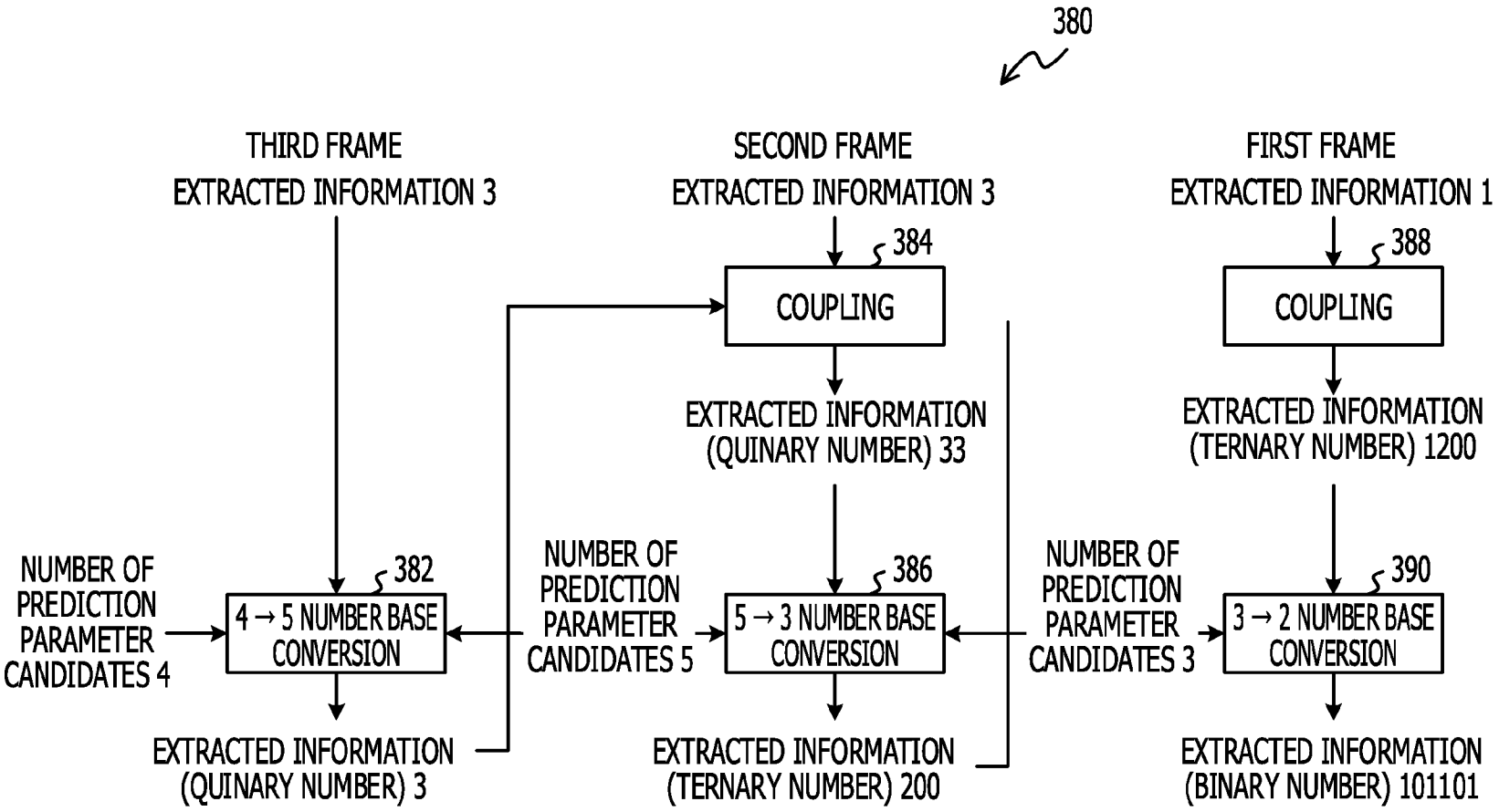
FIG. 26 illustrates an example of information conversion performed by a number base conversion unit.

Further, processing of the number base conversion unit 46 is described with reference to FIG. 26. FIG. 26 illustrates an example of information conversion performed by the number base conversion unit 46. As depicted in FIG. 26, an information conversion example 380 is an example of processing of a case in which the buffer information 370 is stored in the extracted information buffer unit 45.

As depicted in FIG. 26, the number base conversion unit 46 converts information which is buffered in the extracted information buffer unit 45 from the last frame so as to extract extracted information. First, the number base conversion unit 46 extracts the embedding value "3" of the third frame as extracted information. Here, the number of candidates of the third frame is "4" and the number of candidates of the second frame is "5", so that the number base conversion unit 46 converts the extracted information "3" from a quaternary number to a quinary number in number base conversion 382. The number base conversion unit 46 obtains "3" of the quinary number as a lower order digit of the extracted information, as a result.

The number base conversion unit 46 extracts the embedding value "3" of the second frame as extracted information as illustrated in the buffer information 370. The coupling unit 47 couples the extracted information "3" obtained from the third frame and the extracted information "3" of the second frame as illustrated in coupling 384 so as to obtain extracted information "33" of a quinary number. At this time, the number of candidates of the second frame is "5" and the number of candidates of the first frame is "3", so that the number base conversion unit 46 converts the extracted information "33" from the quinary number to a ternary number in number base conversion 386. The number base conversion unit 46 obtains "200" of the ternary number as a lower order digit of the extracted information, as a result.

The number base conversion unit 46 extracts the embedding value "1" of the first frame as extracted information as illustrated in the buffer information 370. The coupling unit 47 couples the extracted information "33" obtained in the processing up to the second frame and the extracted information "1" of the first frame as illustrated in coupling 388 so as to obtain extracted information "1200" of a ternary number. At this time, the number of candidates of the first frame is "3" and the original extracted information is a binary number, so that the number base conversion unit 46 converts the extracted information "1200" from the ternary number to a binary number in number base conversion 390. As a result, the number base conversion unit 46 obtains "101101" of a binary number as extracted information.

Figure 27:
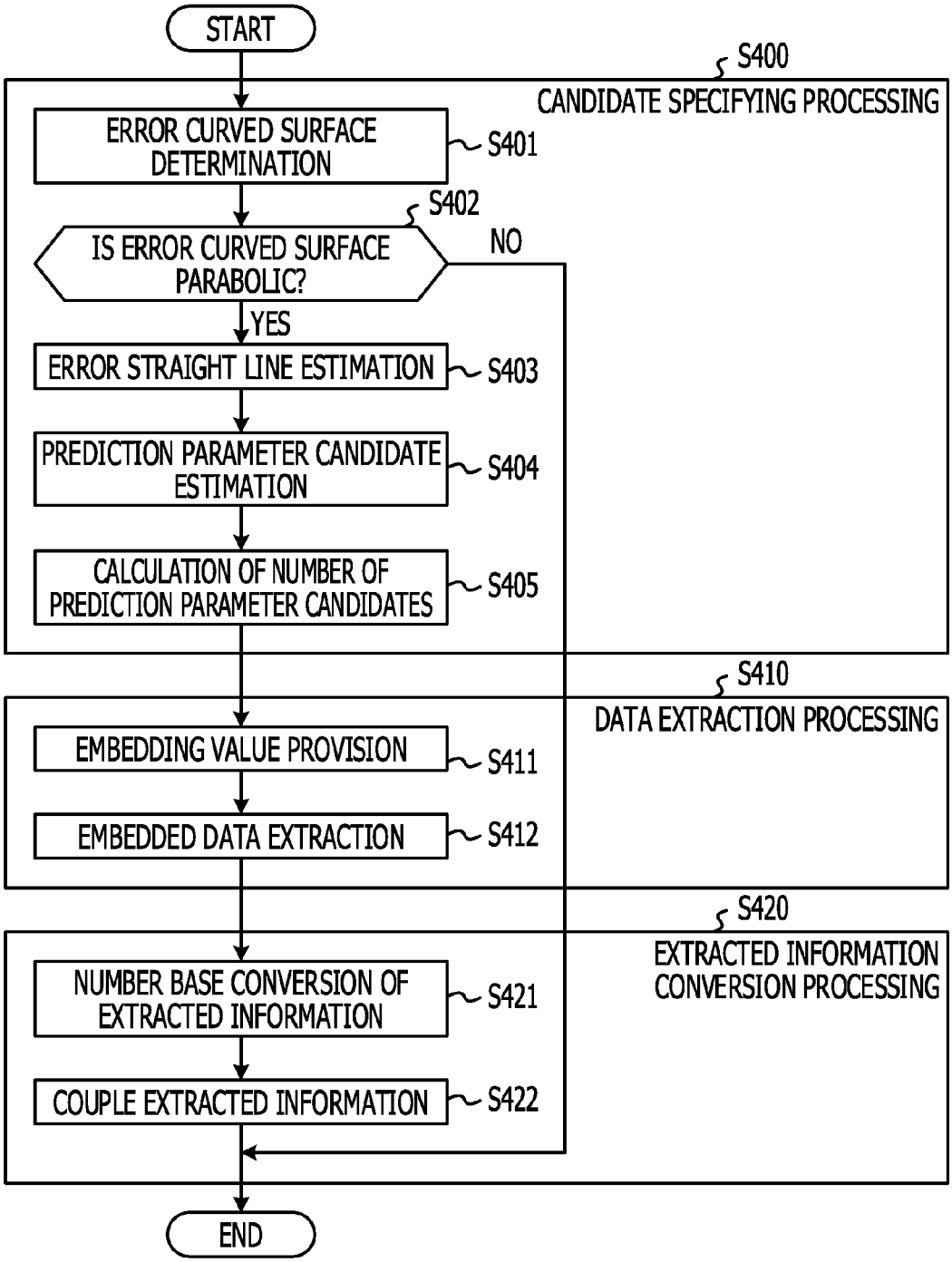
FIG. 27 is a flowchart illustrating processing of the decode system.

Subsequently, the processing of the decode system 3 according to the embodiment is further described with reference to FIG. 27. FIG. 27 is a flowchart illustrating the processing of the decode system 3. As illustrated in FIG. 27, the candidate specifying unit 42 performs candidate specifying processing in S400. This processing specifies candidates of a prediction parameter which are extracted by the candidate extraction unit 22, from the code book 41, on the basis of a prediction parameter which is received from the separation unit 31 and a stereo frequency signal which is restored by the stereo decoding unit 32. Details of this candidate specifying processing is further described.

First, the candidate specifying unit 42 performs error curved surface determination processing in S401. This processing determines a shape of an error curved surface and is similar to the processing which is performed by the candidate extraction unit 22 as the processing of S231 of FIG. 19. However, in the processing of S401, an inner product of signal vectors of stereo signals, which are outputted from the stereo decoding unit 32, of the left channel and the right channel is obtained to calculate a value of above-mentioned formula (4), and the shape of an error curved surface is determined depending on whether or not this value is zero.

Subsequently, the candidate specifying unit 42 performs processing for determining whether or not the shape, which is determined through the error curved surface determination processing of S401, of the error curved surface is parabolic in S402. Here, when the candidate specifying unit 42 determines that the shape of the error curved surface is parabolic (S402: YES), the candidate specifying unit 42 goes to processing of S403 to proceed the processing for data extraction. On the other hand, when the candidate specifying unit 42 determines that the shape of the error curved surface is not parabolic (is elliptical) (S402: NO), the candidate specifying unit 42 determines that embedding of data into a prediction parameter has not been performed and ends this control processing of FIG. 27.

In S403, the candidate specifying unit 42 performs error straight line estimation processing. This processing estimates an error straight line which is decided by the candidate extraction unit 22 through the error straight line decision processing of S233 of FIG. 19. The processing of S403 is similar to the error straight line decision processing of S233 of FIG. 19. However, in the error straight line estimation processing of S403, estimation of an error straight line is performed by assigning stereo signals, which are outputted from the stereo decoding unit 32, of the left channel and the right channel to respective signal vectors of the right sides of above-mentioned formula (5), formula (6), and formula (7).

Subsequently, the candidate specifying unit 42 performs prediction parameter candidate estimation processing in S404. This processing is processing for estimating candidates of a prediction parameter which are extracted by the candidate extraction unit 22 through the prediction parameter candidate extraction processing of S234 of FIG. 19, and is processing for extracting candidates of a prediction parameter from the code book 41 on the basis of an error straight line which is estimated through the processing of S403. This processing of S404 is similar to the prediction parameter candidate extraction processing of S234 of FIG. 19. However, in the prediction parameter candidate estimation processing of S404, points of which distances from an error straight line are smallest and identical are selected among points which correspond to respective prediction parameters which are stored in the code book 41, so as to extract pairs of prediction parameters represented by the selected points. Extracted pairs of prediction parameters are specifying results of prediction parameter candidates specified by the candidate specifying unit 42.

Subsequently, the candidate specifying unit 42 performs calculation processing of the number N of prediction parameter candidates in S405. This processing is processing for calculating a data capacity which permits embedding and is processing similar to the processing which is performed by the data embedding unit 42 as the processing of S235 of FIG. 19. Thus, the candidate specifying unit 42 performs the above-described processing from S401 to S405 as the candidate specifying processing of S400.

When the candidate specifying processing of S400 performed by the candidate specifying unit 42 is completed, the data extraction unit 43 subsequently performs data extraction processing in S410. This processing extracts data which is embedded into coded data by the data embedding unit 23, from candidates of a prediction parameter which are specified by the candidate specifying unit 42, on the basis of the data embedding rule which has been used in embedding of data by the data embedding unit 23.

Details of the data embedding processing are further described. First, the data extraction unit 43 performs embedding value provision processing in S411. This processing provides an embedding value to each of candidates of a prediction parameter which are extracted through the prediction parameter candidate estimation processing of S404, on the basis of a rule identical to the rule which has been used in the embedding value provision processing of S251 of FIG. 19 by the data embedding unit 23.

Then, the data extraction unit 23 performs processing for extracting embedded data in S412. This processing acquires the embedding value which is provided in the embedding value provision processing of S411 to a prediction parameter which is received from the separation unit 31 and buffers this value as an extraction result of data which is embedded by the data embedding unit 23, in a predetermined storage region in an acquisition order. Thus, the data extraction device 40 performs the above-described control processing. Accordingly, data which is embedded by the data embedding device 20 is extracted.

Subsequently, the extracted information conversion unit 44 performs extracted information conversion processing of extracted data. This processing obtains original extracted information by converting the number base of extracted data on the basis of the number N of prediction parameter candidates in a frame from which the data is extracted.

The number base conversion unit 46 converts information which is embedded into a frame into a base-n number which is based on the number N of prediction parameter candidates of the frame in sequence from the last frame, in the buffer information 370 which is stored in the extracted information buffer unit 45. The coupling unit 47 couples the converted base-n number with converted embedded information which is obtained from the previous frame (S422). As described thus far, the data extraction processing is performed by the data extraction device 40.

A simulation result of capacity of data which may be embedded through the above-described control processing is described with reference to FIG. 28. FIG. 28 illustrates a simulation result of data embedding quantity. In the simulation depicted in FIG. 28, twelve kinds (sound, music, and the like) of one-minute audio signals of 5.1 channels of the MPEG surround system of which a sampling frequency is 48 kHz and a transmission rate is 160 kb/s were used.

In this simulation, a capacity of data which may be embedded was 360 kb/s and it was found that it was possible to embed 2.7 kilobytes of data in conversion into a one-minute audio signal.

As described above, according to the data embedding device 20 and the data extraction device 40, it is possible to embed embedded information into coded data and extract the embedded information from the coded data into which the embedded information is embedded. Further, prediction errors, in prediction coding which is performed by using selected prediction parameters, of all of candidates of a prediction parameter which are options in selection of a prediction parameter for embedding of data performed by the data embedding device 20 are within a predetermined range. Accordingly, if the range of a prediction error is sufficiently narrowed, deterioration of information which is restored through prediction coding for up-mix performed by the first up-mix unit 33 of the decoder device 30 is not recognized.

Further, the data embedding device 20 converts embedded information into a base-n number corresponding to the number N of prediction parameter candidates which is extracted in a frame which is an embedding object when the data embedding device 20 embeds embedded information into coded data, so as to sequentially embed a number which does not exceed N from the higher order digit. Therefore, it is possible to use all prediction parameter candidates for embedding of embedded information. Accordingly, it is possible to efficiently embed embedded information with respect to the number N of prediction parameter candidates. Further, there is such advantage that it is possible to increase kinds of data which may be embedded as embedded information.

The data extraction device 40 is capable of extracting embedded information which is embedded by the data embedding device 20, on the basis of a prediction parameter and the number N of prediction parameter candidates, in accordance with the embedding rule in the data embedding device 20. For example, the data extraction device 40 is capable of extracting embedded information which is embedded by the data embedding device 20, by extracting embedding values on the basis of a prediction parameter and the number N of prediction parameter candidates from a frame, into which information is finally embedded, for example, and mutually coupling the embedding values.

(Modification 1)

An embedded information embedding method and an embedded information extraction method according to modification 1 of the above-described embodiment is described with reference to FIGS. 29 and 30. Configurations and operations same as those of the above-described embodiment are given the same reference characters and duplicate description thereof is omitted in this modification.

Figure 29:
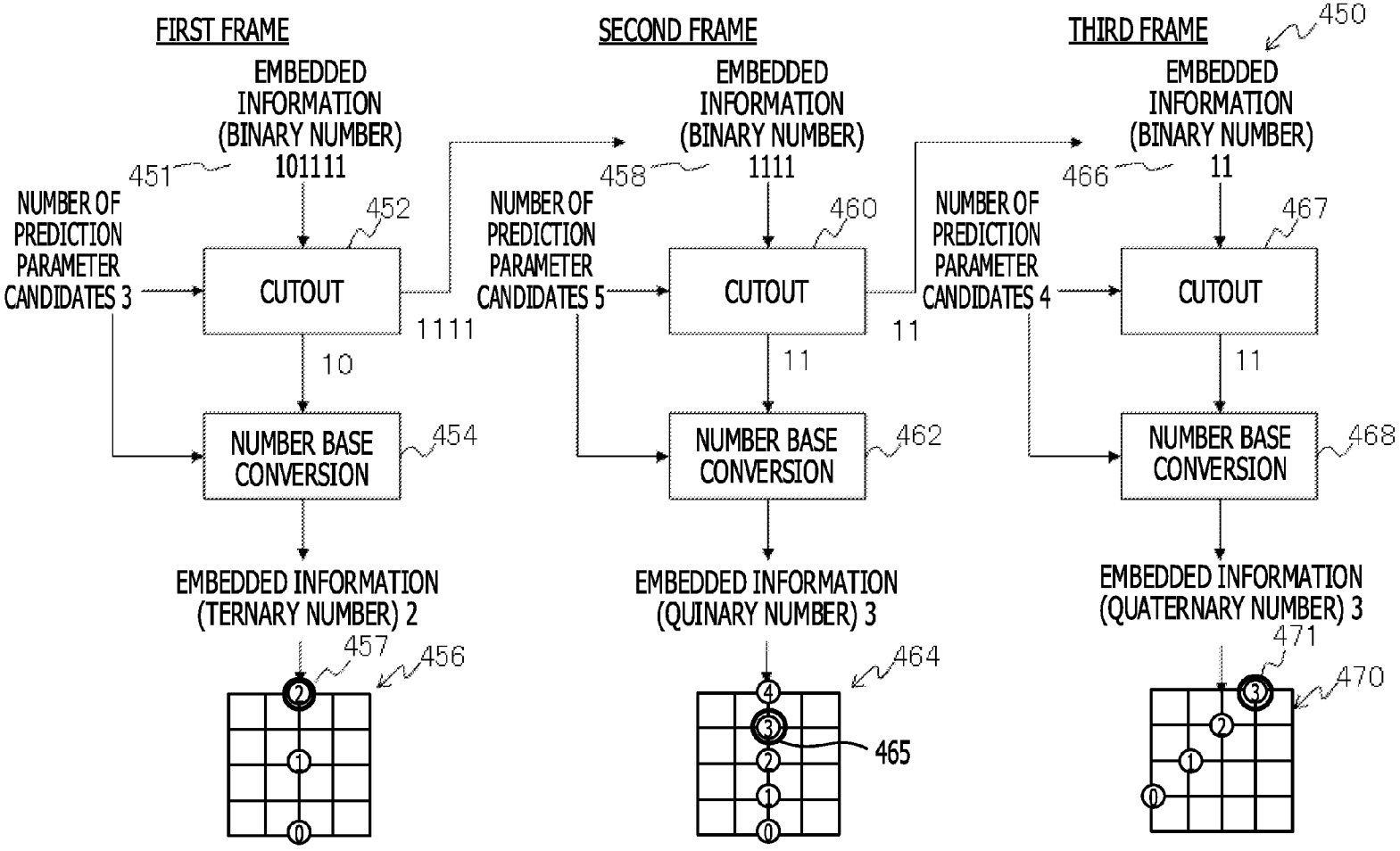
FIG. 29 illustrates an example of an embedded information embedding method according to modification 1.

FIG. 29 illustrates an example of an embedded information embedding method according to modification 1. FIG. 29 illustrates processing which is performed instead of the embedded information embedding method which has been described with reference to FIG. 18. FIG. 29 illustrates processing of which is performed by the candidate extraction unit 22, the embedded information conversion unit 24, and the data embedding unit 23 in modification 1. In an information conversion example 450 of FIG. 29, embedded information 451="101111" is set on the first frame, for example. In this case, the embedded information conversion unit 24 acquires the number of prediction parameter candidates N=3 from the candidate extraction unit 22. The embedded information conversion unit 24 cuts out a number which does not exceed the number N of prediction parameter candidates ("10" in this example) in cutout 452 from a higher order digit of the embedded information 451. The embedded information conversion unit 24 further converts the cut-out part of the embedded information ("10" in this example) into a base-n number ("2" of a ternary number, in this example) in number base conversion 454. The data embedding unit 23 selects a prediction parameter 457 which corresponds to an embedding value "2" from candidates which are extracted as a prediction parameter candidate extraction example 456, so as to embed part of the embedded information into the prediction parameter of the first frame.

Subsequently, the embedded information conversion unit 24 acquires the number of prediction parameter candidates N=5 from the candidate extraction unit 22 on a second frame. The embedded information conversion unit 24 cuts out a number which does not exceed the number N of prediction parameter candidates ("11" in this example) from the rest of the embedded information which is embedded in the first frame (embedded information 458="1111" in this example) in cutout 460 from a higher order digit of the embedded information 458. The embedded information conversion unit 24 further converts the cut-out part of the embedded information ("11" in this example) into a base-n number ("3" of a quinary number, in this example) in number base conversion 462. The data embedding unit 23 selects a prediction parameter 465 which corresponds to an embedding value "3" from candidates which are extracted as a prediction parameter candidate extraction example 464, so as to embed part of the embedded information into the prediction parameter of the second frame.

Further, the embedded information conversion unit 24 acquires the number of prediction parameter candidates N=4 from the candidate extraction unit 22 on a third frame. The embedded information conversion unit 24 cuts out a number which does not exceed the number N of prediction parameter candidates ("11" in this example) from the rest of the embedded information other than the part embedded in the first and second frames (embedded information 466="11" in this example) in cutout 467 from a higher order digit of the embedded information 466. The embedded information conversion unit 24 further converts the cut-out part of the embedded information ("11" in this example) into a base-n number ("3" of a quaternary number, in this example) in number base conversion 468. The data embedding unit 23 selects a prediction parameter 471 which corresponds to an embedding value "3" from candidates which are extracted as a prediction parameter candidate extraction example 470, so as to embed part of the embedded information into the prediction parameter of the third frame.

Figure 30:
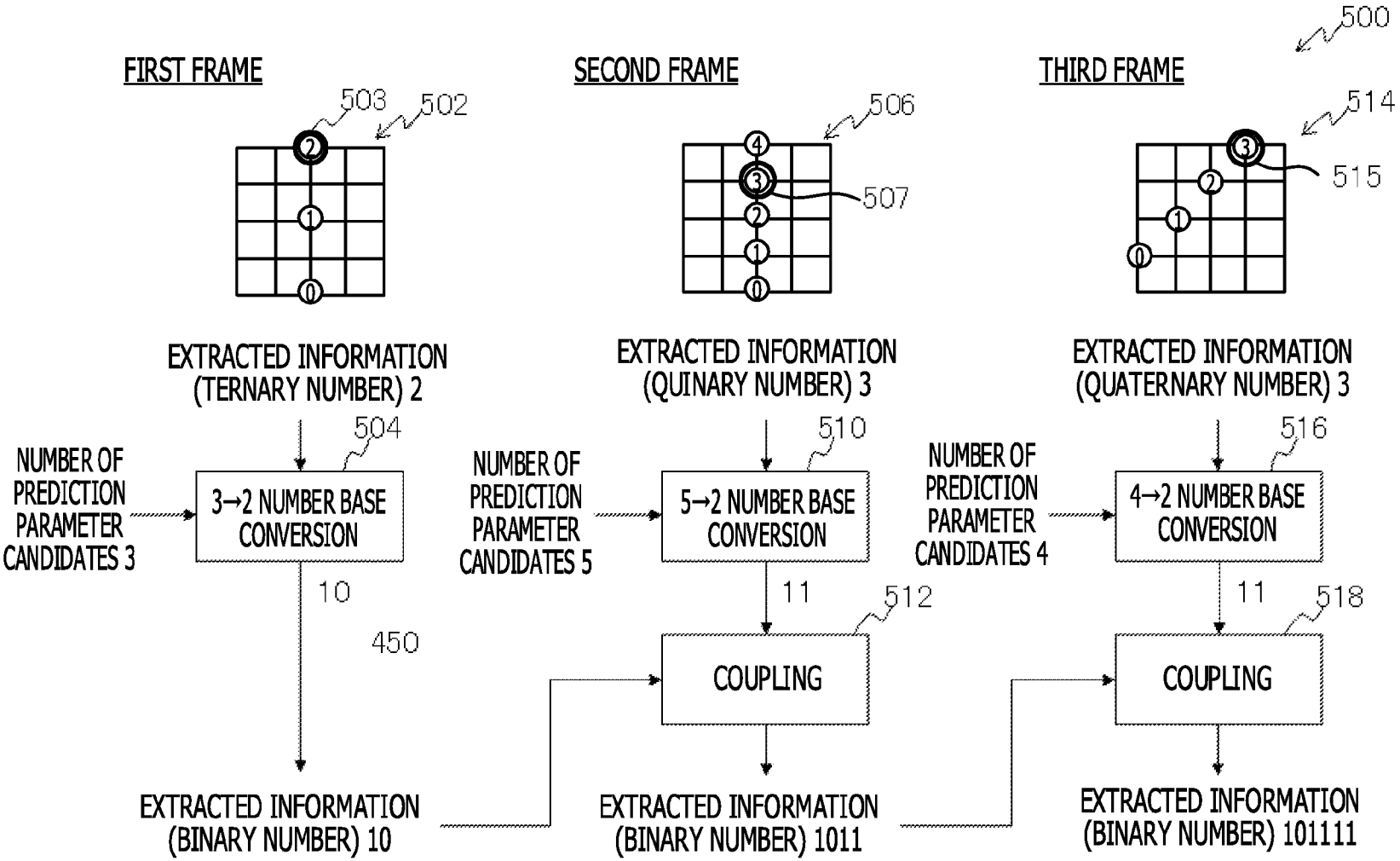
FIG. 30 illustrates an example of an information extraction method according to modification 1.

FIG. 30 illustrates an example of an embedded information extraction method according to the modification. FIG. 30 illustrates processing which is performed instead of the embedded information extraction method which has been described with reference to FIG. 26. In the processing of FIG. 30, the number base conversion unit 46 converts extracted information extracted from the first frame, for example, into a binary number on the basis of the number N of prediction parameter candidates and the extracted information buffer unit 45 buffers the converted information so as to restore embedded information.

In the example of FIG. 30, the candidate extraction unit 22 first extracts an embedding value "2" of a ternary number as extracted information from a prediction parameter 503 of the first frame, as a prediction parameter extraction example 502. The extracted information conversion unit 44 converts the extracted information from a ternary number into a binary number "10" in number base conversion 504 on the basis of the number of prediction parameter candidates N=3 which is extracted by the candidate extraction unit 22.

The candidate extraction unit 22 extracts an embedding value "3" of a quinary number as extracted information from a prediction parameter 507 of the second frame, as a prediction parameter extraction example 506. The extracted information conversion unit 44 converts the extracted information from the quinary number into a binary number "11" in number base conversion 510 on the basis of the number of prediction parameter candidates N=5 which is extracted by the candidate extraction unit 22. Further, the extracted information conversion unit 44 couples the information extracted from the first frame and the information extracted from the second frame with each other as coupling 512 so as to obtain "1011".

Further, the candidate extraction unit 22 extracts an embedding value "3" of a quaternary number as extracted information from a prediction parameter 515 of the third frame, as a prediction parameter extraction example 514. The extracted information conversion unit 44 converts the extracted information from the quaternary number into a binary number "11" in number base conversion 516 on the basis of the number of prediction parameter candidates N=4 which is extracted by the candidate extraction unit 22. The extracted information conversion unit 44 couples the information extracted from the first frame, the information extracted from the second frame, and the information extracted from the third frame as coupling 518 so as to obtain "101111".

Through the above-described processing, the whole of embedded information 451 is embedded as a prediction parameter and the embedded information which is embedded is extracted. As described above, the processing of FIG. 29 is performed instead of the processing of FIG. 18 and the processing of FIG. 30 is performed instead of the processing of FIG. 26, being able to realize an advantageous effect similar to that of the above-described embodiment.

(Modification 2)

Modification 2 in which another data different from embedded information which is an embedding object is embedded by the data embedding device 20 is now described. Any data may be embedded into a prediction parameter by the data embedding device 20. Here, another data representing a head of embedded information is additionally embedded, facilitating search of the head of the embedded information from data which is extracted by the data extraction device 40. Further, another data representing a tail end of embedded information is additionally embedded, facilitating search of the tail end of the embedded information from data which is extracted by the data extraction device 40. Modification 2 is an example of a method for embedding another data different from embedded information.

In modification 2, after the data embedding unit 23 adds another data which represents existence of embedded information and a head or a tail end of the embedded information before or after data of the embedded information, the data embedding unit 23 embeds the embedded information into a prediction parameter. An example of this modification 2 is described with reference to FIG. 31.

Figure 31:
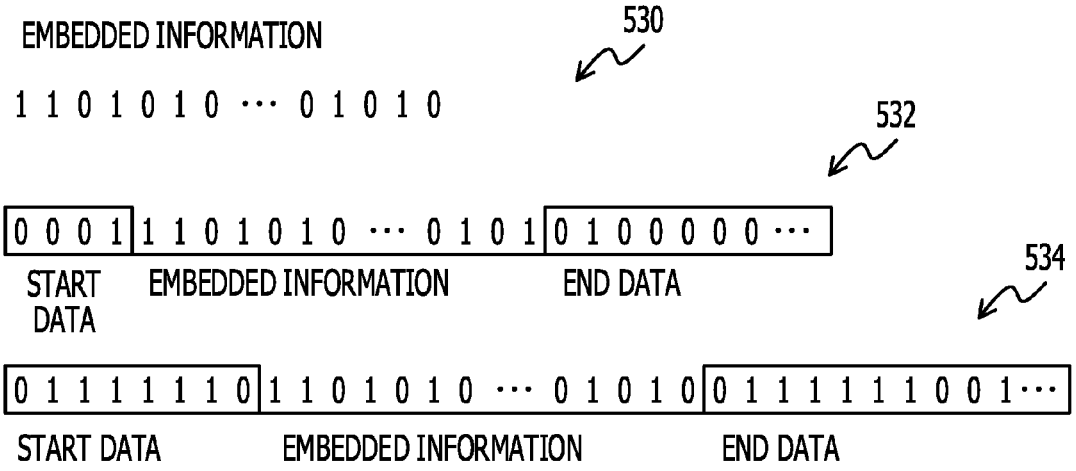
FIG. 31 illustrates an example of a data embedding method according to modification 2.

FIG. 31 illustrates an example of a data embedding method according to modification 2. In the example of FIG. 31, embedded information is set to be embedded information 530="1101010 . . . 01010". In a data example 532, a bit string "0001" is predefined as start data which represents existence of the embedded information 530 and a head of the embedded information 530. Further, a bit string "1000" is predefined as end data which represents a tail end of the embedded information 530. However, it is assumed that neither of these two types of bit strings does not appear in a bit string of the embedded information 530 in this case. That is, it is assumed that a value "0" does not successionally appear three or more times in the embedded information 530, for example.

In this example, the data embedding unit 23 first performs processing for adding start data immediately before embedded information and further adding end data immediately after the embedded information in the prediction parameter selection processing of S252 of FIG. 19. Subsequently, the data embedding unit 23 refers to a bit string corresponding to a value which does not exceed the number N of prediction parameter candidates in the data example 532 in which these pieces of data have been added, thus performing processing for selecting candidates of a prediction parameter to which an embedding value accorded with the value of the bit string is added. Here, the data extraction unit 43 of the data extraction device 40 excludes these start data and end data from data which is extracted from a prediction parameter through the embedded information extraction processing of S412 of FIG. 27 and outputs the rest of the data.

Further, a data example 534 is an example of a case in which a bit string "01111110" is predefined as start/end data which represents existence of the embedded information 530 and a head or a tail end of the embedded information 530. However, it is assumed that neither of these bit strings does not appear in the embedded information 530 in this case. That is, it is assumed that a value "1" does not successionally appear six or more times in the embedded information 530, for example. In this example, the data embedding unit 23 first performs processing for adding start and end data immediately before and after the embedded information 530 in the prediction parameter selection processing of S252 of FIG. 19. Subsequently, the data embedding unit 23 refers to a bit string corresponding to a value which does not exceed the number N of prediction parameter candidates in the data example 532 in which these pieces of data have been added, thus performing processing for selecting candidates of a prediction parameter to which an embedding value accorded with the value of the bit string is added. Here, the data extraction unit 43 of the data extraction device 40 excludes the start and end data from data which is extracted from a prediction parameter through the embedded information extraction processing of S412 of FIG. 27 and outputs the rest of the data.

As described above, according to this modification, another data which represents a head of embedded information is additionally embedded, facilitating search of the head of the embedded information from data which is extracted by the data extraction device 40. Further, another data which represents a tail end of embedded information is additionally embedded, facilitating search of the tail end of the embedded information from data which is extracted by the data extraction device 40.

(Modification 3)

Another method for embedding another data different from embedded data is now described with reference to FIGS. 32 and 33. As described above, processing which is performed in each function block of the data embedding device 20 is performed for every frequency component signal of each of bands which are obtained by dividing an audio frequency band of one channel. That is, the candidate extraction unit 22 extracts a plurality of candidates of a prediction parameter of which difference from the prediction parameter, which is obtained for every frequency band through prediction coding of each frequency band with respect to a signal of a central channel, is within a predetermined threshold value, from the code book 21 for every frequency band. Therefore, in this modification 3, the data embedding unit 23 selects a prediction parameter which is a result of prediction coding of a first frequency band, from candidates which are extracted for the first frequency band, so as to embed embedded information into the prediction parameter. Then, the data embedding unit 23 selects a prediction parameter which is a result of prediction coding of a second frequency band which is different from the first frequency band, from candidates which are extracted for the second frequency band, so as to embed another data into the prediction parameter.

A specific example of this another data embedding according to modification 3 is described with reference to FIG. 32. FIG. 32 illustrates an example of a data embedding method according to modification 3. In this example, candidates of three pairs on a lower frequency side are used for embedding of embedded information and candidates of three pairs on a higher frequency side are used for embedding of another data, among candidates of a prediction parameter which are obtained in each of six frequency bands for each frame of an audio signal. As another data in this case, data which represents existence of embedded information and start or end of the embedded information may be used as is the case with modification 2 described above, for example.

Figure 32:
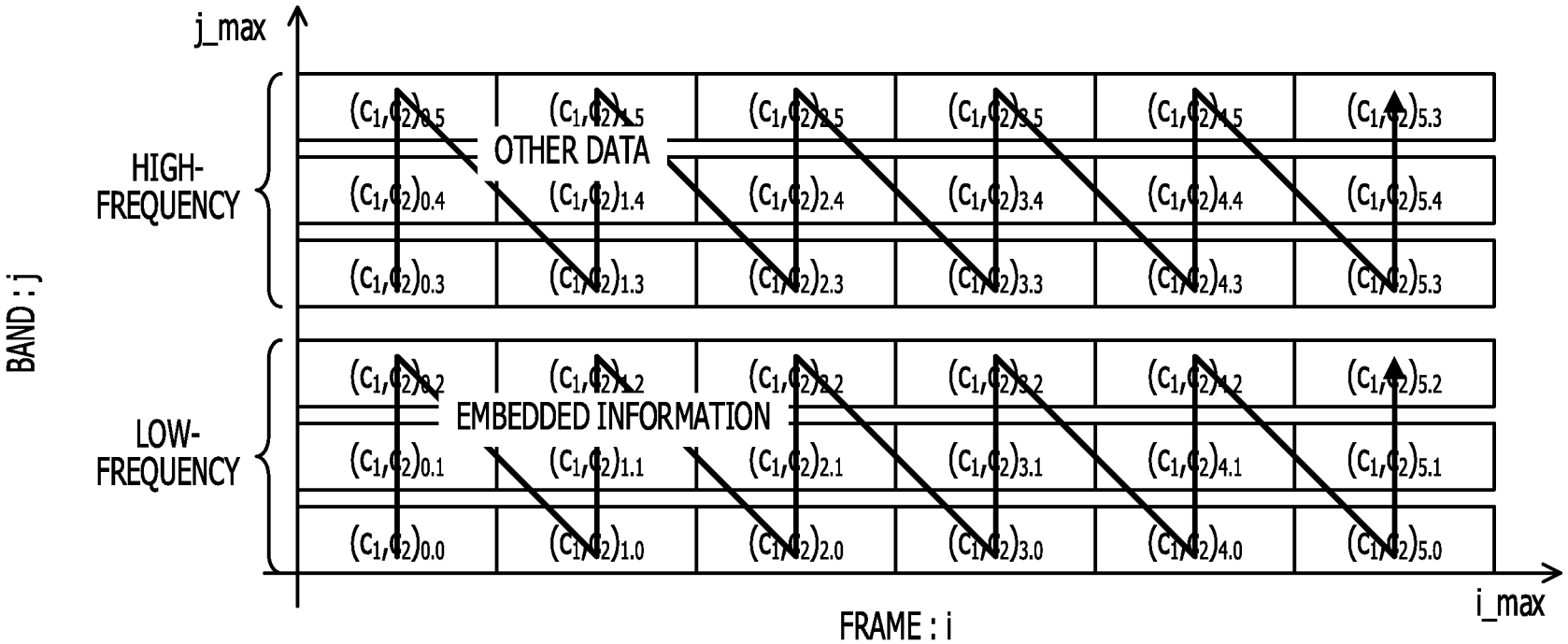
FIG. 32 illustrates an example of a data embedding method according to modification 3.

In FIG. 32, a variable number i is an integer which is from zero to i_max inclusive and represents a number which is provided to each frame of an audio signal in the order of time. Further, a variable number j is an integer which is from zero to j_max inclusive and represents a number which is provided to each frequency band in the ascending order of frequencies. Here, values of a constant number i_max and a constant number j_max may be set to be "5", for example. Further, $(c_1,c_2)_{ij}$ represents a prediction parameter on the j-th band of the i-th frame.

Figure 33:
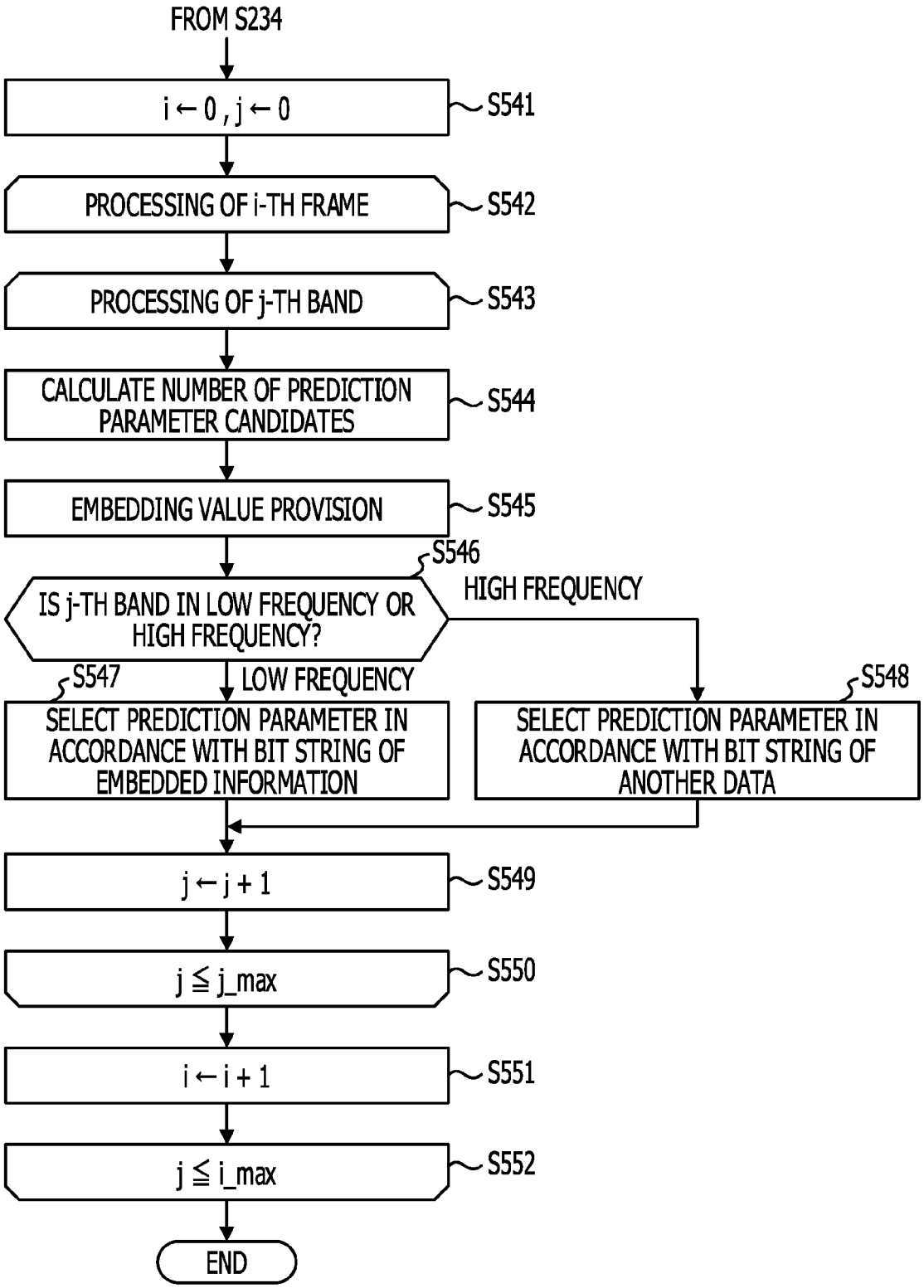
FIG. 33 is a flowchart illustrating a processing content of control processing which is performed in the data embedding device in modification 3.

FIG. 33 is described here. FIG. 33 is a flowchart illustrating a processing content of a modification of control processing which is performed in the data embedding device 20. This flowchart illustrates processing for embedding embedded information and another data as the example illustrated in FIG. 32 and is performed by the data embedding unit 23 as data embedding processing which follows the processing of S234 in the flowchart illustrated in FIG. 19.

Subsequent to S234 of FIG. 19, the data embedding unit 23 first performs processing for assigning an initial value "0" to the variable number i and the variable number j in S541. In S542 following S541 represents a loop of processing while being paired with S552. The data embedding unit 23 repeats processing from S543 to S551 by using a value of the variable number i of this time point of the processing.

Following S543 represents a loop of processing while being paired with S550. The data embedding unit 23 repeats processing from S544 to S549 by using a value of the variable number j of this time point of the processing.

In following S544, the data embedding unit 23 performs calculation processing of the number N of prediction parameter candidates. This processing calculates a bit string, which may be embedded, by using candidates of a prediction parameter of the j-th band of the i-th frame and is similar to that of S235 of FIG. 19.

Subsequently, the data embedding unit 23 performs embedding value provision processing in S545. This processing provides an embedding value to each of candidates of a prediction parameter of the j-th band of the i-th frame, in accordance with a predetermined rule, and is similar to that of S251 of FIG. 19.

Then, in S546, the data embedding unit 23 performs processing for determining whether the j-th band belongs to the lower frequency side or the higher frequency side. When the data embedding unit 23 determines that the j-th band belongs to the lower frequency side, the data embedding unit 23 goes to processing of S547. When the data embedding unit 23 determines that the j-th band belongs to the higher frequency side, the data embedding unit 23 goes to processing of S548.

Subsequently, in S547, the data embedding unit 23 performs prediction parameter selection processing corresponding to a bit string of embedded information and then goes to processing of S549. This processing refers to a bit string corresponding to a value which does not exceed the number N of prediction parameter candidates in the embedded information. Further, this processing selects candidates of a predication parameter to which an embedding value accorded with the value of this bit string is added, from candidates of a prediction parameter of the j-th band of the i-th frame. A processing content of this processing is similar to the processing of S252 of FIG. 19.

On the other hand, in S548, the data embedding unit 23 performs prediction parameter selection processing corresponding to a bit string of another data different from embedded information and then goes to processing of S549. This processing refers to a bit string corresponding to a value which does not exceed the number N of prediction parameter candidates in the corresponding other information. Further, this processing selects candidates of a predication parameter to which an embedding value accorded with the value of this bit string is added, from candidates of a prediction parameter of the j-th band of the i-th frame. A processing content of this processing is also similar to the processing of S252 of FIG. 19.

Subsequently, the data embedding unit 23 performs processing for assigning a result which is obtained by adding "1" to a present value of the variable number j, to the variable number j in S549. In S550, the data embedding unit 23 performs processing for determining whether or not to continue the loop of processing represented while being paired with S543. When the data embedding unit 23 determines that a value of the variable number j is equal to or lower than the constant number j_max, the data embedding unit 23 continues repetition of the processing from S544 to S549. On the other hand, when the data embedding unit 23 determines that a value of the variable number j exceeds the constant number j_max, the data embedding unit 23 ends the repetition of the processing from S544 to S549 to go to processing of S551. In S551, the data embedding unit 23 performs processing for assigning a result which is obtained by adding "1" to a present value of the variable number i, to the variable number i again.

Then, in S552, the data embedding unit 23 performs processing for determining whether or not to continue the loop of processing represented while being paired with S542. When the data embedding unit 23 determines that a value of the variable number i is equal to or lower than the constant number i_max, the data embedding unit 23 continues repetition of the processing from S543 to S551. On the other hand, when the data embedding unit 23 determines that a value of the variable number i exceeds the constant number i_max, the data embedding unit 23 ends the repetition of the processing from S543 to S551 to end this control processing. The data embedding device 20 performs the control processing described above, so as to embed embedded information and another illustrated in FIG. 32 data into a prediction parameter.

Here, the data extraction unit 43 of the data extraction device 40 performs processing similar to the processing illustrated in FIG. 33 in the data extraction processing of S410 of FIG. 27, so as to extract embedded information and another data.

(Modification 4)

Still another example of embedding of another data different from embedded information is described below with reference to FIG. 34. Data representing existence of embedded information and start or end of the embedded information is cited as an example of another data which is embedded in modification 2 and modification 3, but modification 4 illustrates an example in which still another data is embedded into a prediction parameter.

In modification 4, when embedded information which has been subjected to error correction coding processing is embedded, data representing whether or not error correction coding processing is performed with respect to embedded information is embedded into a prediction parameter as another data.

FIG. 34 illustrates an example of error correction coding processing with respect to embedded information. In the example of FIG. 34, original data 561 is original data before subjected to the error correction coding processing. This error correction coding processing is processing in which a value of each bit constituting the original data 561 is outputted three times successionally. Error correction coding data 563 is obtained by performing this error correction coding processing with respect to the original data 561. The data embedding device 20 embeds the error correction coding data 563 into a prediction parameter and embeds data representing that the error correction coding processing is performed with respect to the error correction coding data 563, into the prediction parameter as another data.

On the other hand, extracted data 565 is information which is extracted by the data extraction device 40 and part of bits of the extracted data 565 is different from the error correction coding data 563. In order to restore the original data 561 from this extracted data 565, the extracted data 565 is divided into bit strings of three bits in an arrangement order and majority processing is performed with respect to values of three bits which are included in each bit string. By aligning results of this majority processing in the arrangement order, corrected data of corrected data 567 is obtained. It is understood that the corrected data 567 is accorded with the original data 561.

Figure 35:
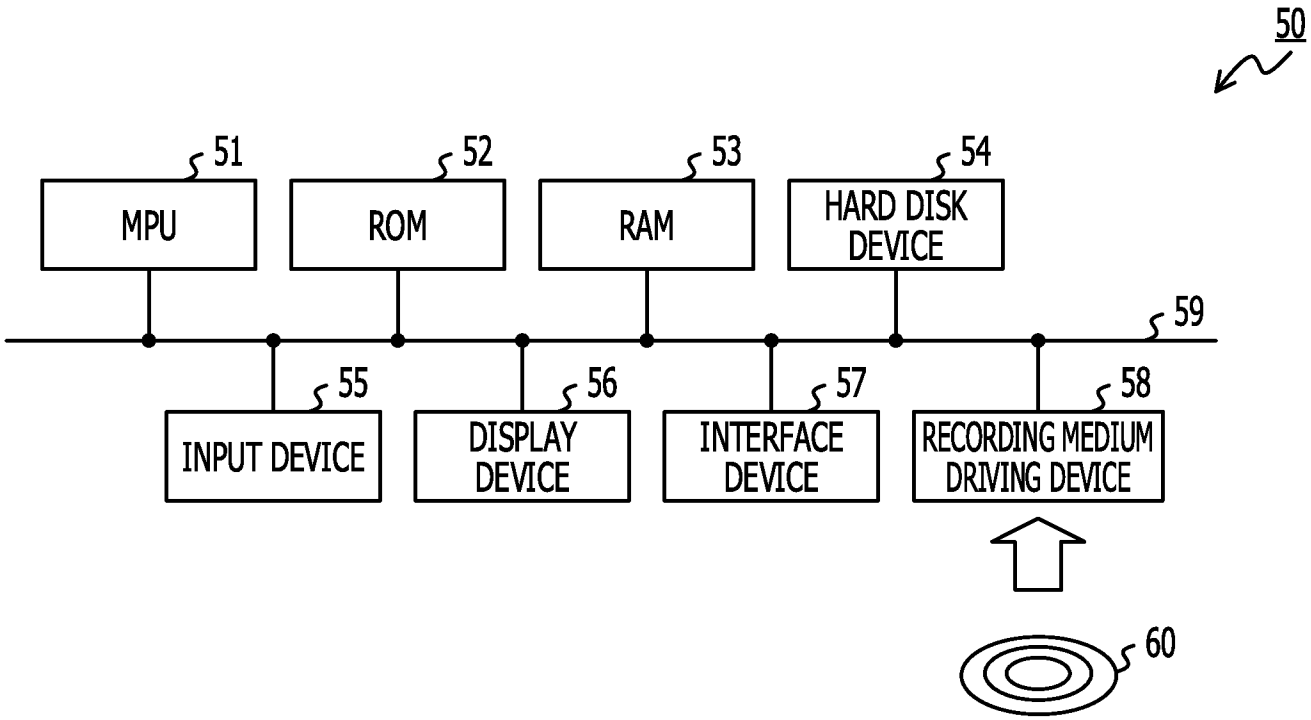
FIG. 35 illustrates the hardware configuration of a standard computer.

The data embedding device 20 and the data extraction device 40 of the embodiment and modifications 1 to 4 described above may be realized by a computer having the standard configuration. FIG. 35 illustrates a configuration example of a computer 50 which may be operated as the data embedding device 20 and the data extraction device 40.

This computer 50 includes a micro processing unit (MPU) 51, a read only memory (ROM) 52, a random access memory (RAM) 53, a hard disk device 54, an input device 55, a display device 56, an interface device 57, and a recording medium driving device 58. These constituent elements are mutually connected via a bus line 59, enabling mutual provision and reception of various types of data under the control of the MPU 51.

The MPU 51 is an arithmetic processing device which controls the whole operation of this computer 50. The ROM 52 is a read only semiconductor memory to which a predetermined basic control program is prerecorded. The MPU 51 reads out and executes this basic control program when the computer 50 is running, being able to control of operations of respective constituent elements of this computer 50. The RAM 53 is a semiconductor memory which is writable and readable at anytime and is used as a work recording region as appropriate when the MPU 51 executes various types of control programs.

The hard disk device 54 is a storage device which stores various types of control programs which are executed by the MPU 51 and various types of data. The MPU 51 reads out and executes a predetermined control program which is stored in the hard disk device 54, being able to perform the above-described control processing. Further, the code books 21 and 41 are prestored in this hard disk device 54, for example. When the computer 50 is operated as the data embedding device 20 and the data extraction device 40, the MPU 51 is allowed to perform processing for reading out the code books 21 and 41 from the hard disk device 54 and storing the code books 21 and 41 in the RAM 53 in advance.

The input device 55 is a keyboard device and a mouse device, for example. When the input device 55 is operated by a user of the computer 50, the input device 55 acquires inputs of various types of information, which is associated with the operation content, from the user and transmits the acquired input information to the MPU 51. For example, the input device 55 acquires data which is to be embedded into coded data.

The display device 56 is a liquid crystal display, for example, and displays various kinds of texts and images in accordance with display data which is transmitted from the MPU 51. The interface device 57 manages provision and reception of various types of data with respect to various type of devices which are connected to this computer 50. For example, the interface device 57 performs provision and reception of coding data and data of a prediction parameter or the like with respect to the encoder device 10 and the decoder device 30.

The recording medium driving device 58 is a device which reads out various types of control programs and data which are recorded in a portable recording medium 60. The MPU 51 reads out and executes a predetermined control program which is recorded in the portable recording medium 60 via the recording medium driving device 58, being able to perform various types of control processing which will be described later. Here, examples of the portable recording medium 60 include a compact disc read only memory (CD-ROM), a digital versatile disc read only memory (DVD-ROM), and a flash memory to which a connector of a universal serial bus (USB) standard is provided.

In order to operate such computer 50 as the data embedding device 20 and the data extraction device 40, a control program for allowing the MPU 51 to perform each processing step of control processing which will be described later is first generated. The generated control program is prestored in the hard disk device 54 or the portable recording medium 60. Then, a predetermined instruction is provided to the MPU 51 to allow the MPU 51 to read and execute this control program. Accordingly, the MPU 51 functions as respective elements included in the data embedding device 20 and the data extraction device 40 which have been respectively illustrated in FIGS. 1 and 21, enabling this computer 50 to operate as the data embedding device 20 and the data extraction device 40.

Here, the embedded information conversion unit 24 is an example of a conversion unit, embedded information is an example of data which is an embedding object, an embedding value is an example of a number which does not exceed the number of candidates, and extracted information is an example of embedded data.

Here, embodiments of the present disclosure are not limited to the above-described embodiment and may employ various configurations or embodiments within a scope of the present disclosure. For example, the example in which cutout from embedded information which has been converted into a predetermined number base is performed from a higher order digit has been described, but other orders may be employed as long as a cutout order is predetermined. Further, the example in which all pieces of embedded information are respectively cut out to be embedded into a prediction parameter has been described, but whether or not all pieces of embedded information are cut out may be controlled.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A device for embedding data upon a prediction coding of a multi-channel signal, the device comprising:

a storage configured to store a code book that includes a plurality of prediction parameter sets, each of the plurality of prediction parameter sets including a plurality of kinds of prediction parameters for a processing regarding the prediction coding;

a processor; and a memory configured to store a plurality of instructions that, when executed by the processor, cause the processor to execute receiving, from an encoder device, coded data that represents the multi-channel signal, receiving embedded information that is to be embedded into the coded data, the coded data corresponding to a prediction parameter from among the plurality of kinds of prediction parameters stored in the storage, extracting a plurality of candidates of a prediction parameter set for the multi-channel signal from the code book, the plurality of candidates being capable of suppressing a prediction error in the prediction coding within a predetermined range;

cutting out a portion of the embedded information as an embedding object, the portion including a predetermined number of digits, converting a first base-n number of the cut-out portion into a second base-n number having a number of digits that does not exceed a number of the extracted candidates;

selecting, from the plurality of candidates, the prediction parameter set corresponding to the embedding object that is converted into the second base-n number; and transmitting the selected prediction parameter set to a multiplexer of the encoder device to be multiplexed with the coded data that has been down-mixed from the multi-channel signal.

2. The device according to claim 1, wherein the converting further comprises:

cutting out a number that does not exceed the number of candidates from a higher order digit of the number base that is converted; and wherein processing for selecting the prediction parameter set is repeated in accordance with the number that does not exceed the number of candidates, in the selecting to embed data.

3. The device according to claim 1, wherein the prediction coding is based on signals of other two channels, of a signal of one channel among signals of a plurality of channels, and the prediction parameter set includes components of respective signals of the other two channels, and wherein a straight line that is aggregation of points, of which the prediction error does not exceed a predetermined threshold value in a plane that is defined by the two components of the prediction parameter set, is decided so as to extract candidates of the prediction parameter set on the basis of a positional relation between the straight line and each point that corresponds to each prediction parameter set, the prediction parameter set being stored in the code book, on the plane, in the extracting.

4. The device according to claim 3, wherein whether or not aggregation of points of which the prediction error does not exceed a predetermined threshold value forms a straight line on the plane is determined, and extraction of candidates of the prediction parameter set, the extraction being based on the positional relation, is performed when it is determined that the aggregation of the points forms a straight line, in the extracting.

5. The device according to claim 3, wherein the plane is a plane of an orthogonal coordinate system and components of directions of respective coordinate axes are two components of the prediction parameter set, wherein each of the prediction parameter sets that are stored in the code book are preset such that respective points corresponding to the candidates are arranged on the plane as grid points in a rectangular region of which directions of respective sides are the directions of the coordinate axes on the plane, and wherein when it is determined that aggregation of points of which the prediction error does not exceed a predetermined threshold value forms a straight line on the plane, whether or not the straight line intersects with both of a pair of sides opposed in the rectangular region of on the plane, and when it is determined that the straight line intersects with both of the pair of sides, a prediction parameter set that corresponds to a grid point closest to the straight line among grid points that exist on each of the pair of sides is extracted and a prediction parameter set that corresponds to a grid point closest to the straight line among grid points that exist on a line, for each line in the region, the line being parallel with the pair of sides and passing through the grid points, is extracted, in the extracting.

6. A device that extracts data that is embedded into a prediction parameter set, the device comprising:

a storage configured to store a code book that includes a plurality of prediction parameter sets, each of the plurality of prediction parameter sets including a plurality of kinds of prediction parameters that are used for a processing regarding the prediction coding;

a processor; and a memory which stores a plurality of instructions that, when executed by the processor, cause the processor to execute, specifying candidates of a prediction parameter set, the candidates being extracted in prediction coding performed in a data embedding device, from the code book on the basis of a prediction parameter set that is a result of the prediction coding and that is received from a decoder device, the prediction coding being based on signals of other two channels, of a signal of one channel among signals of a plurality of channels and the signals of the other two channels, and specifying the number of candidates of the prediction parameter set;

extracting a number that is embedded into the prediction parameter set by the data embedding device and does not exceed the number of candidates, from the candidates, the candidates being specified, of the prediction parameter set, on the basis of a predetermined data embedding rule, which is used in embedding of information performed by the data embedding device, corresponding to a number base based on the number of candidates;

performing reverse conversion of number base conversion into a number base based on the number of candidates, with respect to the number that is extracted and does not exceed the number of candidates; and extracting data that is embedded by the data embedding device, on the basis of a conversion result of the converting, and outputting the extracted data.

7. The device according to claim 6, wherein the extracting includes extracting in sequence a plurality of numbers that are respectively embedded into a plurality of the prediction parameter sets and do not exceed the number of candidates; and wherein the performing reverse conversion further comprises:

storing the numbers that are extracted and do not exceed the number of candidates and a plurality of numbers of candidates, the numbers of candidates corresponding to the numbers that do not exceed the number of candidates, on the basis of an order of extraction performed by the extracting;

converting the numbers that do not exceed the number of candidates, into a number base based on the number of candidates, the number of candidates corresponding to a number that does not exceed the number of candidates of an immediately previous order; and coupling a first bit string that corresponds to the number base that is converted by the converting and is based on the number of candidates, the number of candidates corresponding to the number that does not exceed the number of candidates of the immediately previous order, and a second bit string that corresponds to the number that does not exceed the number of candidates of the immediately previous order; and wherein when a number that does not exceed the number of candidates of the immediately previous order does not exist, an output result of the coupling is subject to reverse conversion of a number base based on the number of candidates, the number of candidates corresponding to a number that does not exceed the number of candidates and having no number which does not exceed the number of candidates in the immediately previous order, so as to be extracted as the data that is embedded, in the converting into a number base.

8. The device according to claim 6, wherein the extracting includes extracting in sequence a plurality of numbers that are respectively embedded into the prediction parameter sets and do not exceed the numbers of candidates;

wherein the performing reverse conversion further comprises;

storing the numbers that are extracted and do not exceed the number of candidates and a plurality of numbers of candidates, the numbers of candidates corresponding to the numbers that do not exceed the number of candidates, on the basis of the order of extraction performed by extracting;

performing reverse conversion of number base conversion into a number base based on the corresponding number of candidates, with respect to a plurality of numbers that do not exceed the number of candidates so as to output a plurality of first bit strings; and coupling the plurality of first bit strings that are outputted by the converting, on the basis of the order so as to couple the coupled bit string with the second bit string; and wherein the second bit string is extracted as the data that is embedded, in the extracting.

9. The device according to claim 6, wherein the prediction parameter set includes components of respective signals of the other two channels, and wherein a straight line that is aggregation of points, of which the prediction error does not exceed a predetermined threshold value in a plane that is defined by the two components of the prediction parameter set, is decided so as to extract candidates of the prediction parameter set on the basis of a positional relation between the straight line and each point that corresponds to each prediction parameter set, the prediction parameter set being stored in the code book, on the plane.

10. A data embedding method for embedding data upon a prediction coding of a multi-channel signal, comprising:

receiving, from an encoder device, coded data that represents the multi-channel signal;

receiving embedded information that is to be embedded into the coded data;

extracting a plurality of candidates of a prediction parameter set for the multi-channel signal from a code book stored in a memory, the code book including a plurality of prediction parameter sets, each of the plurality of prediction parameter sets including a plurality of kinds of prediction parameters for a processing regarding the prediction coding, the plurality of candidates being capable of suppressing a prediction error in the prediction coding within a predetermined range;

cutting out a portion of the embedded information as an embedding object, the portion including a predetermined number of digits;

converting, by a computer processor, a first base-n number of the cut-out portion into a second base-n number having a number of digits that does not exceed a number of the extracted candidates;

selecting, from the plurality of candidates, the prediction parameter set corresponding to the embedding object that is converted into the second base-n number; and transmitting the selected prediction parameter set to a multiplexer of the encoder device to be multiplexed with the coded data that has been down-mixed from the multi-channel signal.

11. A data extraction method, comprising:

specifying candidates of a prediction parameter set, the candidates being extracted in prediction coding performed in a data embedding device, from a code book, the code book being included in a data extraction device performing the data extraction method and including a plurality of prediction parameter sets, each of the plurality of prediction parameter sets including a plurality of kinds of prediction parameters for processing regarding the prediction coding, on the basis of a prediction parameter set that is a result of the prediction coding and that is received from a decoder device, the prediction coding being based on signals of other two channels, of a signal of one channel among signals of a plurality of channels and the signals of the other two channels, and specifying the number of candidates of the prediction parameter set;

extracting, by a computer processor, a number that is embedded into the prediction parameter set by the data embedding device and does not exceed the number of candidates, from the candidates, the candidates being specified, of the prediction parameter set, on the basis of a predetermined data embedding rule, which is used in embedding of information performed by the data embedding device, corresponding to a number base based on the number of candidates; and extracting data that is embedded by the data embedding device, by performing reverse conversion of number base conversion into a number base based on the number of candidates, with respect to the number that is extracted and does not exceed the number of candidates, and outputting the extracted data.

12. A non-transitory computer-readable storage medium storing a data embedding program for embedding data upon a prediction coding of a multi-channel signal, the program causing a computer to execute a process comprising:

receiving, from an encoder device, coded data that represents the multi-channel signal;

receiving embedded information that is to be embedded into the coded data;

extracting a plurality of candidates of a prediction parameter set for the multi-channel signal from a code book stored in a memory, the code book including a plurality of prediction parameter sets, each of the plurality of prediction parameter sets including a plurality of kinds of prediction parameters for a processing regarding the prediction coding, the plurality of candidates being capable of suppressing a prediction error in the prediction coding within a predetermined range;

cutting out a portion of the embedded information as an embedding object, the portion including a predetermined number of digits;

converting, by a computer processor, a first base-n number of the cut-out portion into a second base-n number having a number of digits that does not exceed a number of the extracted candidates;

selecting, from the plurality of candidates, the prediction parameter set corresponding to the embedding object that is converted into the second base-n number; and transmitting the selected prediction parameter set to a multiplexer of the encoder device to be multiplexed with the coded data that has been down-mixed from the multi-channel signal.

13. A non-transitory computer-readable storage medium storing a data extraction program that causing a computer to execute a process, comprising:

specifying candidates of a prediction parameter set, the candidates being extracted in prediction coding performed in a data embedding device, from a code book, the code book being included in a data extraction device, which executes the data extraction program, and including a plurality of prediction parameter sets, each of the plurality of prediction parameter sets including a plurality of kinds of prediction parameters for processing regarding the prediction coding, on the basis of a prediction parameter set that is a result of the prediction coding and that is received from a decoder device, the prediction coding being based on signals of other two channels, of a signal of one channel among signals of a plurality of channels and the signals of the other two channels, and specifying the number of candidates of the prediction parameter set;

extracting a number that is embedded into the prediction parameter set by the data embedding device and does not exceed the number of candidates, from the candidates, the candidates being specified, of the prediction parameter set, on the basis of a predetermined data embedding rule, which is used in embedding of information performed by the data embedding device, corresponding to a number base based on the number of candidates; and extracting data that is embedded by the data embedding device, by performing reverse conversion of number base conversion into a number base based on the number of candidates, with respect to the number that is extracted and does not exceed the number of candidates, and outputting the extracted data.

* * * * *